US008523181B2

(12) United States Patent
Watanabe

(10) Patent No.: US 8,523,181 B2
(45) **Date of Patent: *Sep. 3, 2013**

(54) GAME MACHINE FOR PLAYING A GAME WITH PLAYING BALLS

(75) Inventor: Naoyuki Watanabe, Nagoya (JP)

(73) Assignee: Kyoraku Industrial Co., Ltd., Nagoya-shi, Aichi (JP)

( * ) Notice: Subject to any disclaimer, the term of this patent is extended or adjusted under 35 U.S.C. 154(b) by 207 days.

This patent is subject to a terminal disclaimer.

(21) Appl. No.: 12/690,355

(22) Filed: Jan. 20, 2010

(65) Prior Publication Data

US 2011/0105209 A1 May 5, 2011

(30) Foreign Application Priority Data

Oct. 30, 2009 (JP) ..... 2009-251139

(51) Int. Cl.
*A63F 7/00* (2006.01)

(52) U.S. Cl.
USPC ..... 273/121 B; 273/120 A; 273/121 R; 273/138.1; 273/138.3

(58) Field of Classification Search
USPC ..... 273/120 A, 121 B, 121 R, 138.1, 273/138.3
See application file for complete search history.

(56) References Cited

U.S. PATENT DOCUMENTS

| | | | | |
|---|---|---|---|---|
| 4,461,475 | A * | 7/1984 | Nakamura | 463/7 |
| 5,547,192 | A * | 8/1996 | Ishibashi | 463/26 |
| 5,603,659 | A * | 2/1997 | Okada | 463/25 |
| 5,664,775 | A * | 9/1997 | Kao | 273/121 B |
| 5,702,303 | A * | 12/1997 | Takemoto et al. | 463/27 |
| 5,704,612 | A * | 1/1998 | Kelly et al. | 273/402 |
| 5,803,451 | A * | 9/1998 | Kelly et al. | 273/118 R |
| 6,224,485 | B1 * | 5/2001 | Dickinson et al. | 463/30 |
| 6,605,011 | B1 * | 8/2003 | Yamamoto et al. | 473/455 |
| 2004/0166928 | A1 * | 8/2004 | Kumagai | 463/20 |
| 2006/0084495 | A1 | 4/2006 | Jaffe et al. | |
| 2011/0101605 | A1 * | 5/2011 | Watanabe | 273/120 A |
| 2011/0101606 | A1 * | 5/2011 | Watanabe | 273/120 A |

FOREIGN PATENT DOCUMENTS

| | | | |
|---|---|---|---|
| JP | 2001-079257 | A | 3/2001 |
| JP | 2006-340895 | A | 12/2006 |

* cited by examiner

*Primary Examiner* — Dmitry Suhol
*Assistant Examiner* — David Duffy
(74) *Attorney, Agent, or Firm* — Schiff Hardin LLP

(57) ABSTRACT

A ticket CPU of a game machine counts up how many sheets of payout tickets were paid out and how many times of jackpot occurred during the performance of one game play. Then, the ticket CPU operates a data display to display the maximum number of payout tickets per one game play on that day and the maximum frequency of jackpots per one game play on that day. Thus, there is provided such game machine that a player can refer to the displayed game information as reference material for deciding the rough standard about amount of inserted medium they may bet.

2 Claims, 28 Drawing Sheets

FIG.8(a)

JACKPOT DETERMINATION TABLE FOR FIRST-SPECIAL-SYMBOL DISPLAY DEVICE

| PROBABILITY GAME STATE | RANDOM NUMBER VALUE FOR SPECIAL-SYMBOL DETERMINATION (0~127) | DETERMINATED RESULT | PROBABILITY (※ REFERENCE) |
|---|---|---|---|
| LOW PROBABILITY GAME STATE | 0, 1 | JACKPOT | 2/128=1/64 |
| | 2~127 | LOSS | 126/128=63/64 |
| HIGH PROBABILITY GAME SATE | 0~127 | JACKPOT | 128/128=1/1 |

FIG.8(b)

JACKPOT DETERMINATION TABLE FOR SECOND-SPECIAL-SYMBOL DISPLAY DEVICE

| PROBABILITY GAME STATE | RANDOM NUMBER VALUE FOR SPECIAL-SYMBOL DETERMINATION (0~127) | DETERMINATED RESULT | RATE (※ REFERENCE) |
|---|---|---|---|
| LOW PROBABILITY GAME STATE | 0, 1 | JACKPOT | 2/128=1/64 |
| | 2~127 | LOSS | 126/128=63/64 |
| HIGH PROBABILITY GAME SATE | 0~127 | JACKPOT | 128/128=1/1 |

FIG.8(c)

WIN DETERMINATION TABLE FOR NORMAL-SYMBOL DISPLAY DEVICE

| RANDOM NUMBER VALUE FOR NORMAL SYMBOL (0~7) | DETERMINATED RESULT | RATE (※ REFERENCE) |
|---|---|---|
| 0 | WIN | 1/8 |
| 1~7 | LOSS | 7/8 |

FIG.9(a)

SYMBOL DETERMINATION TABLE AT JACKPOT

| SPECIAL-SYMBOL DISPLAY DEVICE | RANDOM NUMBER VALUE FOR DETERMINING SYMBOL OF JACKPOT (0~99) | SPECIAL SYMBOL | STOP SYMBOL DATA | PERFORMANCE-SYMBOL - SPECIFYING COMMAND | |
|---|---|---|---|---|---|
| | | | | MODE | DATA |
| FIRST SPECIAL-SYMBOL DISPLAY DEVICE | 0~59 | FIRST SPECIAL SYMBOL 1 OF JACKPOT | 01 | E0H | 01H |
| | 60~99 | FIRST SPECIAL SYMBOL 1 OF NORMAL WIN | 02 | E0H | 02H |
| SECOND SPECIAL-SYMBOL DISPLAY DEVICE | 0~59 | SECOND SPECIAL SYMBOL 1 OF JACKPOT | 03 | E1H | 01H |
| | 60~99 | SECOND SPECIAL SYMBOL 1 OF NORMAL WIN | 04 | E1H | 02H |

FIG.9(b)

SYMBOL DETERMINATION TABLE AT LOSS

| SPECIAL-SYMBOL DISPLAY DEVICE | SPECIAL SYMBOL | STOP SYMBOL DATA | PERFORMANCE-SYMBOL - SPECIFYING COMMAND | |
|---|---|---|---|---|
| | | | MODE | DATA |
| FIRST SPECIAL-SYMBOL DISPLAY DEVICE | SPECIAL SYMBOL 0 | 00 | E0H | 00H |
| SECOND SPECIAL-SYMBOL DISPLAY DEVICE | SPECIAL SYMBOL 0 | 00 | E1H | 00H |

FIG.10

POST JACKPOT CONDITION DATA TABLE

| SPECIAL-SYMBOL DISPLAY DEVICE | SPECIAL SYMBOL | STOP SYMBOL DATA | PROBABILITY GAME STATE |
|---|---|---|---|
| FIRST-SPECIAL-SYMBOL DISPLAY DEVICE | FIRST SPECIALSYMBOL 1 FOR JACKPOT | 01 | HIGH PROBABILITY GAME STATE |
| | FIRST SPECIAL SYMBOL 1 FOR NORMAL WIN | 02 | LOW PROBABILITY GAME STATE |
| SECOND-SPECIAL-SYMBOL DISPLAY DEVICE | SECOND SPECIALSYMBOL 1 FOR JACKPOT | 03 | HIGH PROBABILITY GAME STATE |
| | SECOND SPECIALSYMBOL 1 FOR NORMAL WIN | 04 | LOW PROBABILITY GAME STATE |

FIG.11

PERFORMANCE-SYMBOL DETERMINATION TABLE AT JACKPOT

| RECEIVED PERFORMANCE-SYMBOL DETERMIATION COMMAND | | SPECIAL SYMBOL | PERFORMANCE SYMBOL DATA | | | CONTENT OF PERFORMANCE SYMBOL |
|---|---|---|---|---|---|---|
| MODE | DATA | | | | | |
| E0H | 01H | FIRST SPECIAL SYMBOL 1 OF JACKPOT | 01H | 01H | 01H | RED7-RED7-RED7 |
| E1H | 01H | SECOND SPECIAL SYMBOL 1 OF JACKPOT | | | | |
| E0H | 02H | FIRST SPECIAL SYMBOL 1 OF NORMAL WIN | 02H | 02H | 02H | BLUE7-BLUE7-BLUE7 |
| E1H | 02H | SECOND SPECIAL SYMBOL 1 OF NORMAL WIN | | | | |

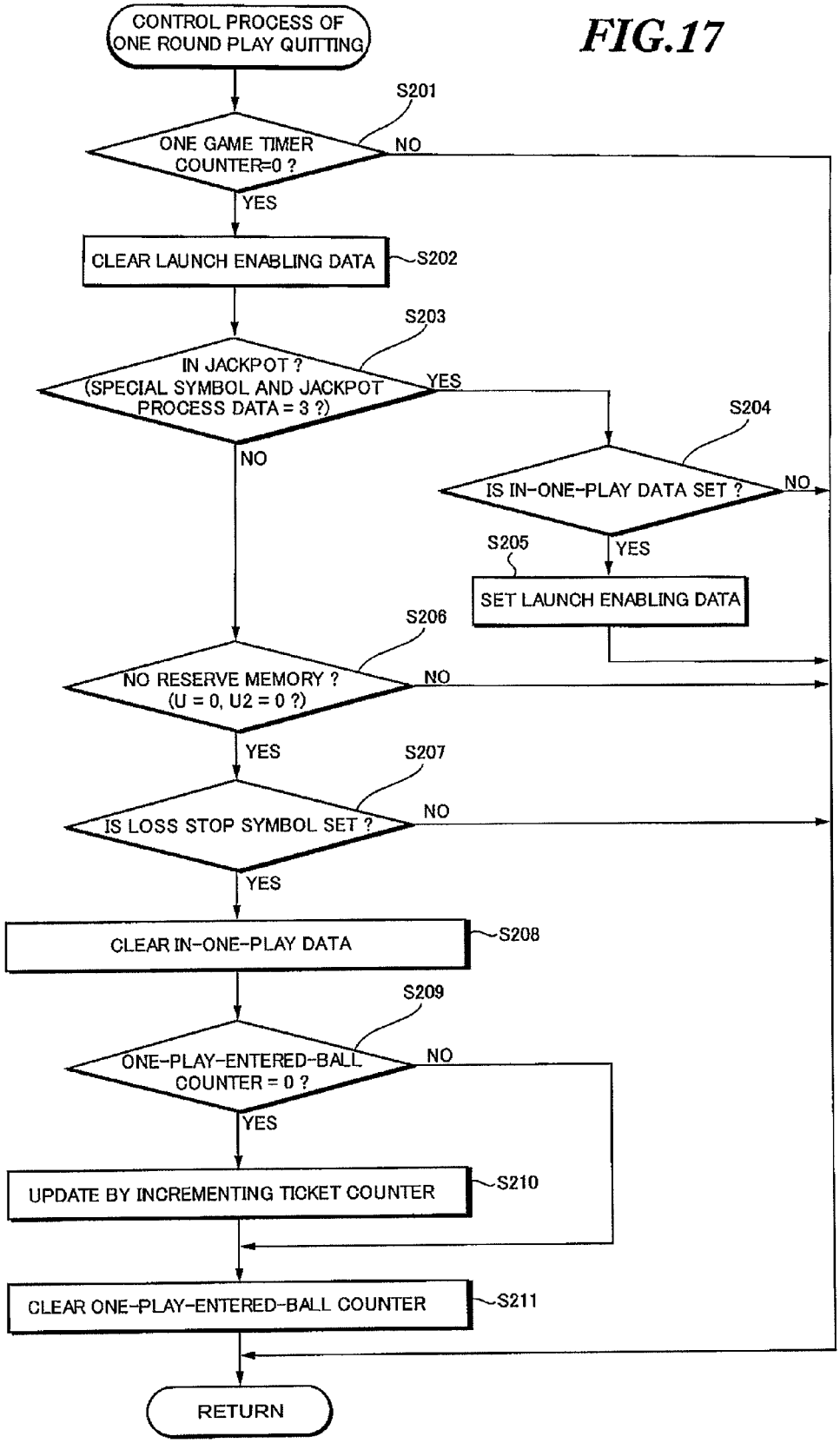
FIG.17
CONTROL PROCESS OF ONE ROUND PLAY QUITTING
S201
ONE GAME TIMER COUNTER=0 ?
NO
YES
CLEAR LAUNCH ENABLING DATA
S202
S203
IN JACKPOT ? (SPECIAL SYMBOL AND JACKPOT PROCESS DATA = 3 ?)
YES
NO
S204
IS IN-ONE-PLAY DATA SET ?
NO
YES
S205
SET LAUNCH ENABLING DATA
S206
NO RESERVE MEMORY ? (U = 0, U2 = 0 ?)
NO
YES
S207
IS LOSS STOP SYMBOL SET ?
NO
YES
CLEAR IN-ONE-PLAY DATA
S208
S209
ONE-PLAY-ENTERED-BALL COUNTER = 0 ?
NO
YES
UPDATE BY INCREMENTING TICKET COUNTER
S210
CLEAR ONE-PLAY-ENTERED-BALL COUNTER
S211
RETURN

GAME MACHINE FOR PLAYING A GAME WITH PLAYING BALLS

TECHNICAL FIELD

The present invention relates to a game machine for performing one game play by receiving a predetermined inserted medium, and in particular, to a game machine that displays information related to one game play.

BACKGROUND OF THE INVENTION

In the conventional game machine such as "pachinko" for playing a game with playing balls, a player first borrows playing balls from a game parlor through paying a predetermined amount of money, and then rotates an operating handle after laying the borrowed balls on a tray of the game machine. Under such a situation, the playing balls are guided toward a launching device by a slope of the tray, thereafter the guided balls are launched toward a playfield formed on a game board by the launching device. After the playing balls reach the playfield, they cascade down in the playfield. When a playing ball enters a specified win hole provided on the playfield, a variation (i.e., change and/or movement) display of symbols is started in a symbol display device. After that, when a specified symbol (jackpot symbol) is stopped and displayed in the symbol display device, a special game (jackpot) is performed. In such a specified game, a jackpot gate provided on the playfield is controlled to remain open for a moment, and as a result, some playing balls much more easily enter the jackpot gate than usual. Thereby, the game machine is configured such that a payout of a predetermined amount of balls is performed into the tray of the game machine upon the reception of playing balls into the jackpot gate (see Japanese patent application laid-open No. 2006-340895).

Besides, it is well known that pachinko parlors generally are equipped with display devices for displaying game information such as frequency of jackpot controlled by the special game, frequency of starting to variably display the symbol and the like (see Japanese patent application laid-open No. 2001-79257). Such a game-information display device is of assistance for players in order to make a better choice of a game machine based on displayed information. As a result, this achieves improvement of service for game players in pachinko parlors.

However, the conventional game-information display device displays only game information of one-day unit (for example, today only or several days). Indeed, the players usually select a game machine through using information displayed on such a display device. However, in the case of any game machine, like that of the present invention, performing only one-round-play by receiving a predetermined inserted medium such as predetermined number of coins, the players cannot predict how much prize they can expect from one-round-play. As a result, the players cannot obtain the rough standard (upper limit) of amount of inserted medium (money) that they can bet.

SUMMARY OF THE INVENTION

Accordingly, an object of the present invention is to provide a game machine which displays such game information that the players can refer to so as to decide the rough standard of amount in inserted medium which they will bet.

The first aspect of the present invention is concerned with a game machine, which comprises: a game board 2 provided with a playfield on which playing balls cascade downward; a launching-operation detector (launching volume 3*a*) configured to detect a launching operation of the playing balls performed by a player; an inserted-medium detector (coin detection switch 201*a*) configured to detect that a predetermined inserted-medium is received into the game machine; a one-game-play execution device (main CPU 101*a*) to perform one game play until predetermined termination conditions are met when the inserted-medium detector detects that the predetermined inserted-medium is received; and a launching device (launching solenoid 4*a* directly connected to hammer 4*b* and launch control circuit board 106) configured to launch the playing balls toward the playfield when the launching operation of the player is detected by the launching-operation detector under the condition that the one game play is currently performed by the one-game-play execution device.

The game machine further comprises: a privilege determination device (regular-win-hole detection switch 7*a*, first start-up-hole detection switch 9*a*, second start-up-hole detection switch 10*a*, jackpot gate detection switch 11*a* and main CPU 101*a*) configured to determine whether a predetermined prize (as privilege) should be given to the player; a privilege giving device (main CPU 101*a* or ticket CPU 200*a*) configured to give the predetermined prize to the player when the privilege determination device determines to grant the predetermined prize; a game-information displaying device (data display 203) configured to display information related to game; a privilege-frequency counter (ticket CPU 200*a*) configured to count frequency of privilege given by the privilege giving device during performance of one game play by the one-game-play execution device; and a game-information controller (ticket CPU 200*a*) configured to control the game information indicating frequency of prize counted by the privilege counter in order to display on the game-information displaying device.

According to the first aspect of the present invention, game information indicating how many times of privilege in one game play was given to players. That is, the game machine of the present invention displays the game information which the player can refer to in order to decide as to how much inserted-medium (for example, a predetermined amount of money) may be consumed for the game.

In other words, the player can predict how much gain can be expected with the inserted medium consumed in one play through using the game information provided by the data display of game machine as reference. In short, the player can decide a rough standard of inserted medium to be consumed for one play, and then can enjoy well-planned game play.

The second aspect of the present invention is concerned with a game machine having the features of the above-mentioned first aspect, which further comprises: a privilege-frequency-in-one-play storing device (payout counter and bonus counter in the ticket RAM 200*c*) configured to store frequency of privilege counted by the privilege-frequency counter during performance of one game play by the one-game-play execution device; and a maximum-frequency-of-privilege storing device (max payout counter and max bonus counter in the ticket RAM 200*c*) configured to store maximum frequency of privilege already counted by the privilege-frequency counter. The game machine further comprises a comparison determination device (ticket CPU200*a*) configured to compare and determine whether the frequency of privilege stored in the privilege-frequency-in-one-play storing device is greater than that of privilege stored in the maximum-frequency-of-privilege storing device; and an update storing device (ticket CPU200*a*) configured to update and store the frequency of privilege stored in the privilege-frequency-in-one-play storing device to the maximum frequency of privilege to be stored in the maximum-frequency-of-privilege storing device, if the comparison determination device determines that the frequency of privilege stored in the privilege-frequency-in-one-play storing device is greater than the stored maximum frequency of privilege. Thereby, the game-information controller controls the game-information displaying device to display game information indicating the frequency of privilege stored in the maximum-frequency-of-privilege storing device.

According to the second aspect of the present invention, the game machine can display game-information indicating the maximum value of frequencies of privilege given to players in one game play.

The third aspect of the present invention is concerned with a game machine having the feature of the above-mentioned first or second aspect, wherein the privilege determination device of the game machine includes a win-hole detector (regular-win-hole detection switch 7*a*, first-start-up-hole detection switch 9*a*, second-start-up-hole detection switch 10*a*, and jackpot-gate detection switch 11*a*) configured to detect that the playing ball enters a predetermined win hole provided on the playfield. Further, the privilege giving device includes a payout device (ticket payout motor 202*a* and ticket control circuit board 200) configured to pay out a payout medium different from the playing ball whenever the win-hole detector detects that the playing ball enters the win hole. In addition, the privilege-frequency counter counts up the number of the payout medium paid out by the payout device as the frequency of privilege during performance of one game play by the one-game-play execution device.

According to the third aspect of the present invention, the game machine can display the game-information indicating how many times the inserted medium was paid out in one game play.

The fourth aspect of the present invention is concerned with a game machine having the feature of the above-mentioned first or second aspect, which further comprises a special electrically-movable-win-hole device (jackpot-gate opening-and-closing flapper 11*b*) that is variable between an opened state in which the playing ball readily enters a special win hole provided on the playfield and a closed state for making it difficult for the playing ball to enter the special win hole. Here, the privilege determination device includes a start-up-hole detector (first-start-up-hole detection switch 9*a* and a second-start-up-hole detection switch 10*a*) configured to detect that the playing ball enters a start-up hole provided on the playfield, and a special game determination device (main CPU 10*a*) configured to determine whether or not to control the special game in which the special electrically-movable-win-hole device is driven into the opened state, when the start-up-hole detector detects that the playing ball enters the start-up hole. Further, the privilege giving device includes a special game controller (main CPU 101*a*) configured to control the special game under the condition that the special game determination device determines to control the special game. Under these features, the privilege-frequency counter counts up the number of the special game controlled by the special game controller as the frequency of the privilege during performance of one game play by the one-game-play execution device.

According to the fourth aspect of the present invention, the game machine can display the game-information indicating how many times the special game was performed during one game play.

Moreover, the term, "a predetermined inserted-medium" mainly means a token such as a medal and coin which are used in a game machine, or metal or paper money, but may be money information or point information as stored in any information storage medium (for example, IC card or IC coin). The term, "one game play" means that the launching operation of playing balls is effectively activated upon reception of a predetermined inserted-medium, the one game play being executed until a predetermined termination condition occurs. Moreover, the term, "one game play" is the same meaning as the term, "one round play". In the embodiment, the term "a predetermined termination condition" means that a predetermined game time (for example, 30 seconds) has lapsed and that all jackpot lotteries based on random number values for determining special symbol which are stored in a reserve memory are finished, and result in "loss". However, the "predetermined termination condition" may mean simply that a predetermined time has lapsed, a predetermined number of balls have been launched, and/or a predetermined number of balls enter a discharge hole which will be described in a later embodiment. The term, "predetermined privilege" means that inserted medium is paid out or that jackpot game is performed.

Further, the term, "a predetermined win hole" means an opening portion where a playing ball can enter, that is, a regular win hole, a start-up hole, and a jackpot gate in the embodiments as mentioned below. Also, the term, "special win hole" mainly means the jackpot gate of the predetermined win holes. In this case, the term, "start-up win hole" mainly means a jackpot-gate opening-and-closing flapper 11*b* in the embodiments as mentioned below. In addition, the term, "payout medium" mainly means a ticket, card or coin, for example, to exchange for a prize, but may be paper or metal money.

According to the present invention, the game machine is capable of displaying the game-information which the players can refer to as reference material for deciding the rough standard of amount of inserted medium which they may bet.

BRIEF DESCRIPTION OF THE DRAWINGS

The foregoing and other objects, features, and advantages of the invention will become more apparent from the following detailed description taken in conjunction with the accompanying drawings, in which:

FIGS. 8(*a*) and 8(*b*) show a jackpot determination table, respectively, and FIG. 8(*c*) shows a hit determination table;

FIGS. 9(*a*) and 9(*b*) show a symbol determination table, respectively;

FIG. 10 shows a post-jackpot set data table;

FIG. 11 shows a performance symbol determination table referred when a jackpot is hit;

FIG. 17 is a flowchart showing the one-play end control processing carried out in the main control circuit board;

DETAILED DESCRIPTION OF THE PREFERRED EMBODIMENTS

Embodiments according to the present invention will be described below in detail with reference to the accompanying drawings.

(Structure of Pachinko Game Machine 1)

Figure 1:
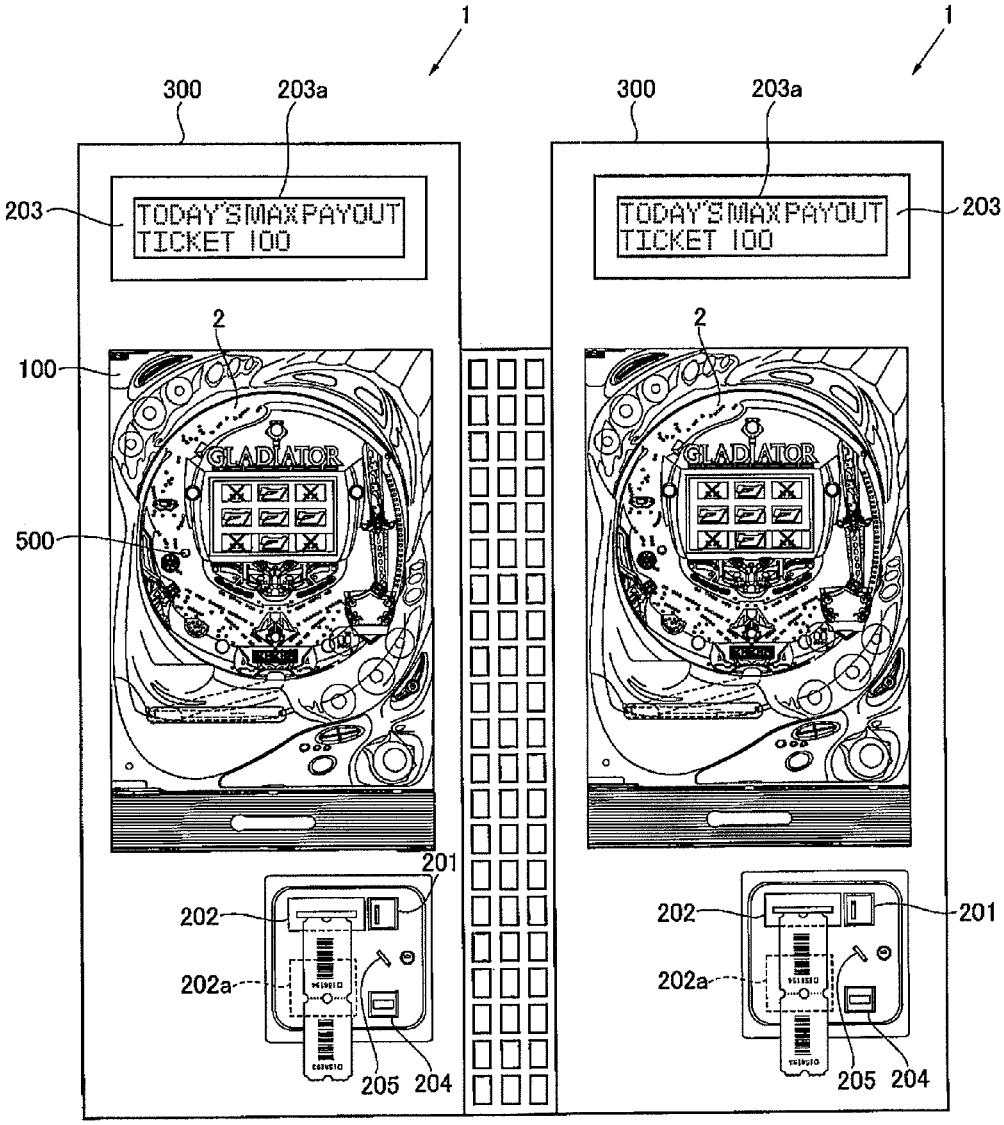
FIG. 1 is a front view of pachinko game machines.

Referring first to FIG. 1, the structure of a pachinko game machine is described in detail. FIG. 1 shows an example of the pachinko game machine according to the present invention, in which two pachinko game machines 1 are arranged.

Each of the pachinko game machines 1 is equipped with a pachinko unit 100 and a main body frame 300 supporting the pachinko unit 100. The pachinko unit 100 launches a playing ball 500 in response to launching operation of a player to allow the player to play the game using the playing ball 500 launched.

Each of the pachinko game machines 1 is equipped with a coin inlet 201 into which a coin of a predetermined amount (for example, 100 yen) as an inserted medium is inserted, a ticket payout slot 202 from which a ticket is paid out, a coin return slot 204 for returning the coin inserted into the coin inlet 201, and a coin return lever 205 for causing the pachinko game machine 1 to return the coin inserted into the coin inlet 201 to the coin return slot 204 when the coin is jammed in the coin inlet 201, all of which are provided below the pachinko unit 100 and operationally connected to each pachinko unit 100. When a coin of a predetermined amount (for example, 100 yen) is inserted into the coin inlet 201, this activates the operation of launching playing balls for at least a predetermined period of play time (for example, 30 seconds) in the pachinko unit 100. In one game play, a ticket is paid out from the ticket payout slot 202 whenever a playing ball 500 enters any of the win holes such as a regular win hole 7, a first start-up hole 9, a second start-up hole 10 and a jackpot gate 11 (see FIG. 2).

Here, the term "one game play" means that the launching operation of playing balls is effectively activated upon reception of a predetermined inserted-medium, the one game play being executed until a predetermined termination condition occurs. In the embodiment, the term "a predetermined termination condition" means that a predetermined game time (for example, 30 seconds) has lapsed and then all jackpot lotteries based on random number values for determining special symbol which are stored in a reserve memory are finished, and result in "loss". However, the "predetermined termination condition" may mean simply that a predetermined time has lapsed, a predetermined number of balls have been launched, and/or a predetermined number of balls enter a discharge hole which will be described in a later embodiment.

Further, a ticket to be paid out from the ticket payout slot 202 is subject to anticounterfeit technology such as an authentication number, a bar code or the like attached thereto, in order to be distinguished from a counterfeit ticket.

The pachinko game machine 1 is equipped with a ticket payout motor 202*a* and a ticket control circuit board 200 for driving the ticket payout motor 202*a*. The ticket payout motor 202*a* is provided with at least two rollers (not shown) between which a payout-ticket is held. Whenever the ticket payout motor 202*a* rotates in the forward direction for one second, the two rollers simultaneously rotate toward the ticket payout slot 202 so as to eject the payout-ticket from between the two rollers to the ticket payout slot 202.

In the embodiment, the ticket payout motor 202*a* and the ticket control circuit board 200 form "payout device".

Each of the pachinko game machines 1 is equipped with a data display 203 on the front and upper portion of the pachinko unit 100, which is operationally connected to the pachinko unit 100. The data display 203 is provided with a data displaying unit 203*a* which includes a dot matrix display having a plurality of light emitting elements (for example, LEDs) and on which game-information for each game play is displayed. The data displaying unit 203*a* displays the maximum number of payout tickets per one game play on that day ("Today's MAX PAYOUT") and the maximum frequency of jackpots per one game play on that day ("Today's MAX BONUS"), which will be described in detail later.

In the embodiment, the data display 203 forms "game information display device".

(Structure of Pachinko Unit)

Figure 2:
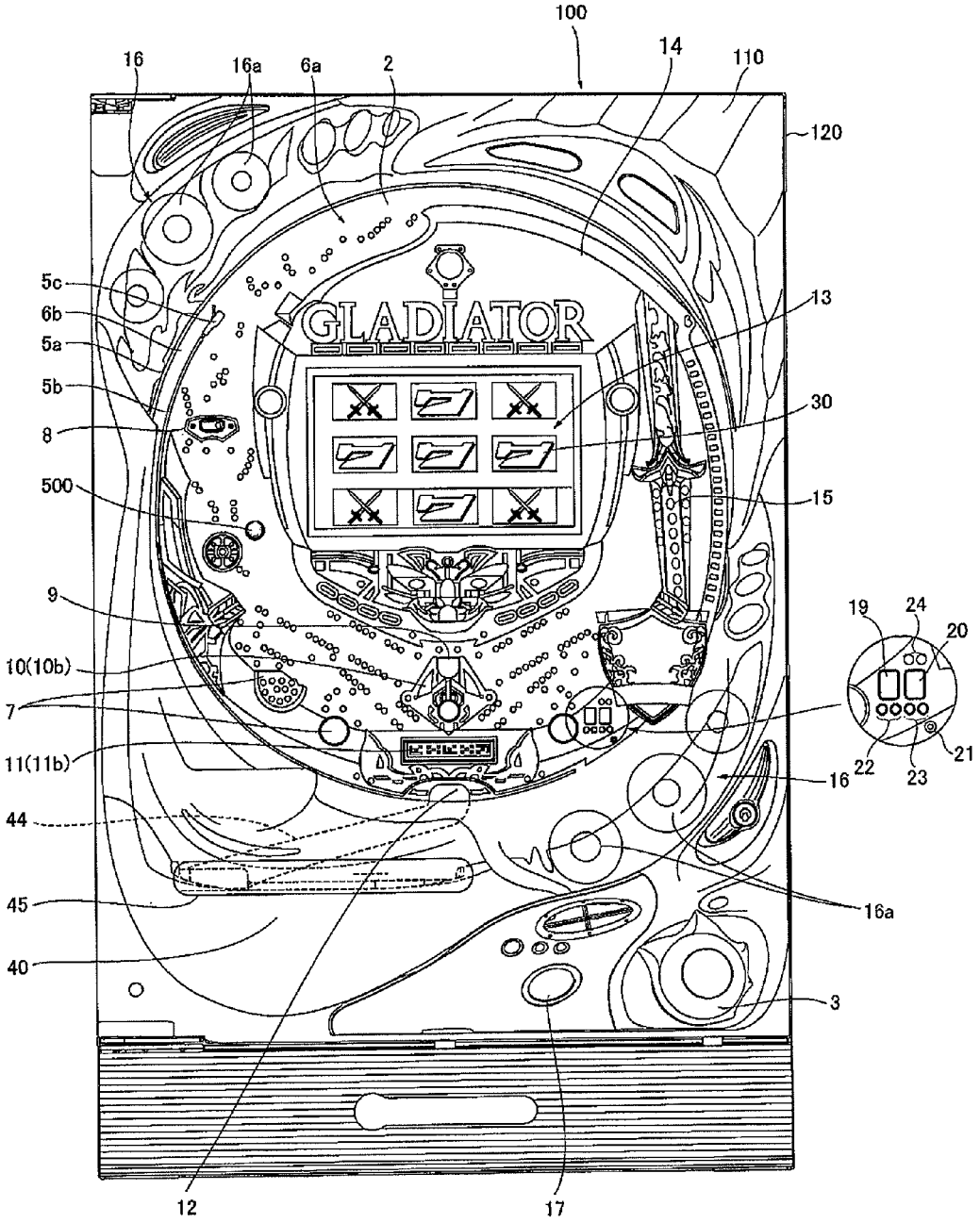
FIG. 2 is a front view of a pachinko unit.
Figure 3:
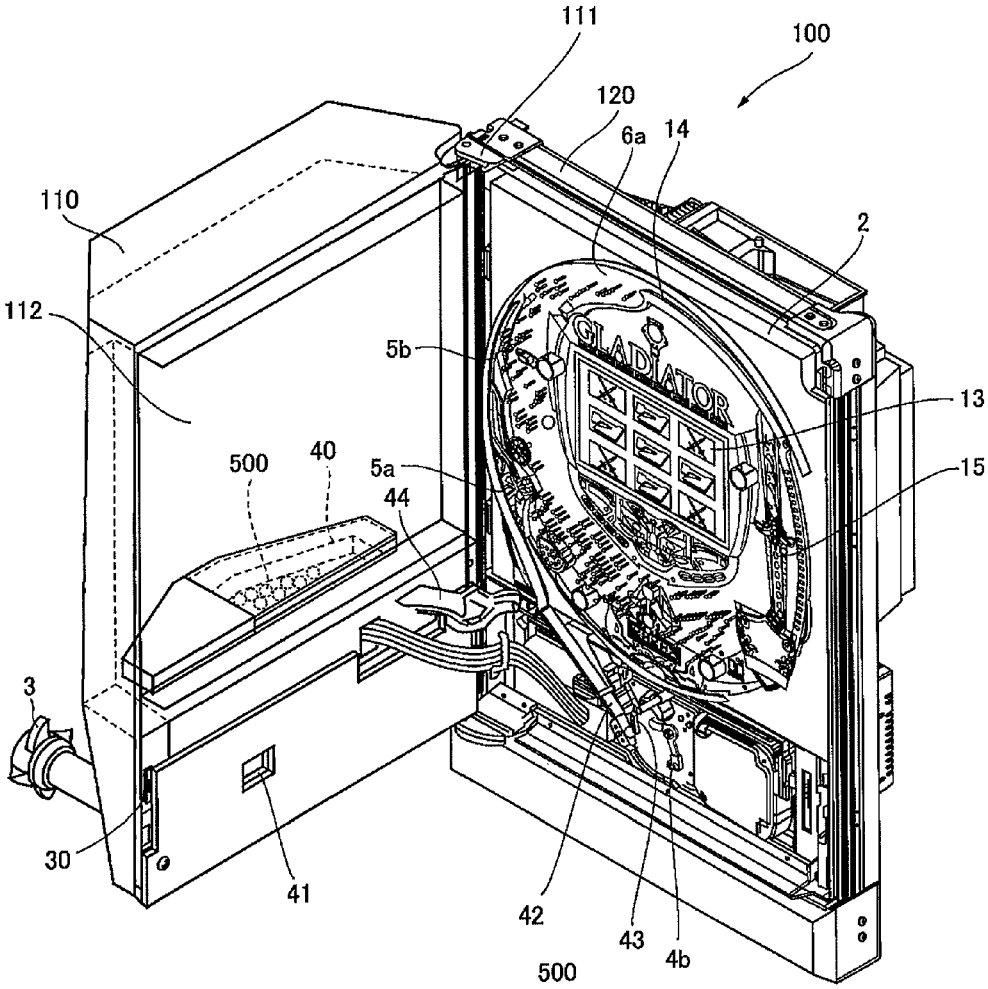
FIG. 3 is a perspective view of the pachinko unit with the glass frame opened.
Figure 4:
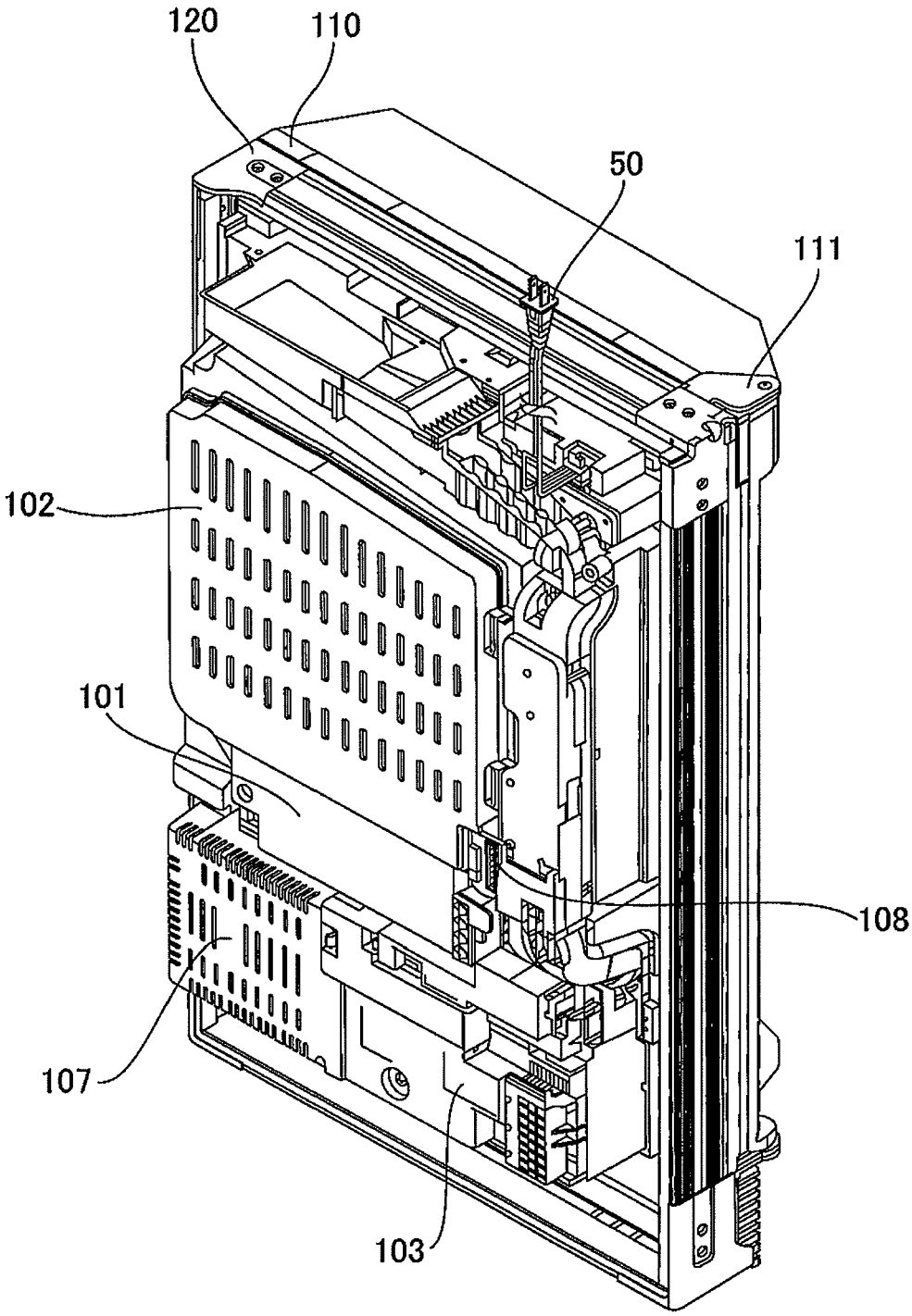
FIG. 4 is a perspective view of the back of the pachinko unit.

Referring next to FIG. 2 to FIG. 4, the structure of a pachinko unit will be described in detail. FIG. 2 is a front view of a pachinko unit according to the present invention. FIG. 3 is a perspective view of the pachinko unit with the glass frame opened according to the present invention. FIG. 4 is a perspective view illustrating the back of the pachinko unit.

The pachinko unit 100 includes a game board 2 on which a playfield 6*a* is provided, and the playing balls 500 cascade down on the playfield 6*a*. A glass frame 110 is mounted in the front side of the playfield 6*a* of the game board 2. An operating handle 3 is rotatably mounted on the glass frame 110 for launching the playing ball toward the playfield 6*a*.

The pachinko unit 100 is provided with a tray 40 guiding a plurality of playing balls 500 stocked therein toward a hammer 4*b* (see FIG. 3) which is provided for striking a playing ball. The tray 40 has a downward slope toward the hammer 4*b*, so that the playing ball is fed to a launching rail 42 through a playing ball passing opening 41 provided in the rear side of the glass frame 110. The launching rail 42 also has a downward slope toward the hammer 4*b* above the lower end of which a stopper 43 is provided for stopping the playing ball.

For this reason, each one of the playing balls 500 guided from the playing ball passing opening 41 is stopped at the lower end of the launching rail 42 (see FIG. 3).

The operating handle 3 is directly connected to a launching volume 3*a* comprising a variable resistor. Accordingly, when the player rotates the operating handle 3, the launching volume 3*a* also rotates. At this stage, the hammer 4*b* is directly connected to a launching solenoid 4*a* comprising a rotary solenoid, so that the hammer 4*b* also rotates upon the rotation of the launching solenoid 4*a*.

The launch control circuit board 106 excites the launching solenoid 4*a*. Accordingly, the hammer 4*b* strikes the playing ball 500 stopped at the lower end of the launching rail 42 at a launching strength determined in accordance with the launching volume 3*a* to launch the playing ball toward the playfield 6*a*.

In the embodiment, the launching volume 3*a* forms the launching-operation detector, and the launching solenoid 4*a* directly connected to the hammer 4*b* and the launch control circuit board 106 form the launching device.

The playing ball 500 thus launched as described above proceeds upward from the launching rail 42 through an range between the rails 5*a*, 5*b* and then beyond a ball-return-preventing piece 5*c*. Thereupon, the playing ball 500 reaches the playfield 6*a* and then cascades downward in the playfield 6*a*. At this stage, the playing ball is caused to cascade unpredictably downward by a plurality of pins and pinwheels which are provided on the playfield 6*a*. In the embodiment, the range where a playing ball proceeds upward from the launching rail 42 through the rails 5*a*, 5*b* to the ball-return-preventing piece 5*c* forms the guidepath for guiding the playing ball to the playfield 6*a*, and the range where the playing ball cascades downward beyond the ball-return-preventing piece 5*c* forms the playfield 6*a*.

A plurality of regular win holes 7 are provided in the playfield 6*a*. Each of the regular win holes 7 is provided with a regular-win-hole detection switch 7*a*. Whenever the regular-win-hole detection switch 7*a* detects the entrance of one playing ball, one sheet of ticket is paid out.

In addition, a normal-symbol gate 8 is provided above the regular win holes 7 in the playfield 6*a* and allows a playing ball to pass therethrough. The normal-symbol gate 8 is equipped with a gate detection switch 8*a* for detecting the passage of a playing ball. When the gate detection switch 8*a* detects the passage of a playing ball, a "lottery for a normal symbol" described later is carried out.

Similarly, to the regular win holes 7, the first start-up hole 9 is provided for receiving a playing ball in the lower portion of the playfield 6*a*. The second start-up hole 10 is provided immediately below the first start-up hole 9. The second start-up hole 10 has a pair of movable pieces 10*b* which are controlled to take the first mode of keeping the pair of movable pieces 10*b* in the closed state or the second mode of bringing the pair of movable pieces 10*b* in the open state. When the second start-up hole 10 is controlled to be in the first mode, the first start-up hole 9 located immediately above the second start-up hole 10 acts as an obstacle that makes the entrance of a playing ball into the second start-up hole 10 difficult or impossible. On the other hand, when the second start-up hole 10 is controlled to be in the second mode, the pair of movable pieces 10*b* functions as a tray, so that a playing ball readily enters the second start-up hole 10. In other words, when the second start-up hole 10 is in the first mode, there is hardly any chance of a playing ball entering the second start-up hole 10, but when it is in the second mode, a playing ball has more chance of entering the second start-up hole 10.

The first start-up hole 9 and the second start-up hole 10 are respectively equipped with a first-start-up-hole detection switch 9*a* and a second-start-up-hole detection switch 10*a* for detecting a playing ball entering there. When each of the detection switches 9*a*, 10*a* detects a playing ball entering the corresponding start-up hole, a "jackpot lottery", which will be described later, is carried out. When either the first-start-up-hole detection switch 9*a* or the second-start-up-hole detection switch 10*a* detects a playing ball entering the corresponding start-up hole, a ticket is also paid out on each detection of a playing ball entering the start-up hole.

In the embodiment, the first start-up hole 9 and the second start-up hole 10 form the start-up win hole, while the first-start-up-hole detection switch 9*a* and the second-start-up-hole detection switch 10*a* form the start-up-hole detector. In addition, the pair of movable pieces 10*b* forms the movable win-hole device.

Further below the second start-up hole 10 a jackpot gate 11 is provided. The jackpot gate 11 is normally kept in the closed state by a jackpot-gate opening-and-closing flapper 11*b* so as to prevent a playing ball from entering there. However, upon the start of a special game described later, the jackpot-gate opening-and-closing flapper 11*b* is opened and also functions as a tray for guiding a playing ball into the jackpot gate 11 to allow a playing ball to enter the jackpot gate 11. The jackpot gate 11 is equipped with a jackpot-gate detection switch 11*a*. Accordingly, whenever the jackpot-gate detection switch 11*a* detects a playing ball entering the jackpot gate, a ticket is paid out.

In the embodiment, the regular win holes 7, the first start-up hole 9, the second start-up hole 10 and the jackpot gate 11 form predetermined win holes. The regular-win-hole detection switches 7*a*, the first-start-up-hole detection switch 9*a*, the second-start-up-hole detection switch 10*a* and the jackpot-gate detection switch 11*a* form the win-hole detector. Also, the jackpot gate 11 forms a special win hole. The jackpot-gate opening-and-closing flapper 11*b* forms the specially movable win hole device.

A discharge hole 12 is provided yet further below the jackpot gate 11, that is, in the lowermost portion of the playfield 6*a* for discharging the playing balls that fail to enter any of the win holes, i.e., regular win holes 7, the first start-up hole 9, the second start-up hole 10 and the jackpot gate 11.

The pachinko unit 100 is provided with a discharge-hole guidepath 44 for guiding the playing balls entering the discharge hole 12 to the tray 40. After the playing ball launched from the tray 40 have entered the discharge hole 12, the discharge-hole guidepath 44 causes the playing balls to return to the tray 40.

The pachinko unit 100 is further provided with a win-hole guidepath (not shown) on the back side of the game board 2 for guiding the playing balls entering the win holes to the discharge-hole guidepath 44. In consequence, each pachinko unit 100 is structured such that all of the playing balls launched from the tray 40 return to the tray 40 so as to circulate in the pachinko unit 100.

The top side of the tray 40 is covered with a lid 45 in order to prevent the playing balls in the tray 40 from being taken out. In the embodiment, particularly, even if the launched playing ball returns to the tray 40, the returning ball cannot be taken out of the tray 40.

In addition, a decorative member 14 is provided in the central portion of the game board 2 in such a manner as to affect the downward falling of the ball. The decorative member 14 has a performance display device 13 mounted on approximately the central portion thereof. The performance display device 13 is equipped with a liquid crystal display (LCD) and the like. A performance figure device 15 including a sword-shaped figure is provided on the right hand side of the performance display device 13. Note that the embodiment employs a liquid crystal display for the performance display device 13, but instead a reel formed of an annular-shaped structure or a display device such as using the so-called seven-segment LEDs or a dot matrix may be used.

The performance display device 13 displays images during standby when a game is not played or images in accordance with the progress of the game. The performance display device 13 displays, among others, nine performance symbols 30 arranged in three columns and three rows for notification of a jackpot lottery result which will be described later. When a specified combination of the performance symbols 30 (for example, "7, 7, 7") appears in any one of a total of 8 vertical, horizontal and diagonal lines, the performance display device 13 stops and displays the specified combination of the performance symbols 30, thereby notifying the player of the occurrence of a jackpot as the jackpot lottery result. More specifically, when a playing ball enters the first start-up hole 9 or the second start-up hole 10, the performance symbols 30 are scrolled and displayed in the nine windows. Then, after a lapse of a predetermined time-period, the performance display device 13 stops the scrolling so as to display the resulting nine performance symbols 30. In the operation of displaying a variation of the performance symbols 30, various images, characters and the like are displayed in order to give the player an excited sense of expectation that a jackpot may be won.

The performance figure device 15 is operated in some modes to give the player a sense of expectation. For example, the performance figure device 15 is operated to pull the sword out of its scabbard. The performance figure device 15 is changed in its operation modes in order to bring out various senses of expectation from the player.

In addition, performance illumination devices 16 are provided in the upper portion and also the lower portion of the game board 2. Each of the performance illumination devices 16 is equipped with a plurality of lights 16*a*, and varies the direction of and the color of light emitted from each light 16*a* to operate various performances.

A performance button 17 is provided on the left-hand side of the operating handle 3. The player can press the performance button 17. For example, the performance button 17 is made active only when the performance display device 13 displays a message for the player to push the performance button 17. The performance button 17 is provided with a performance-button detection switch 17*a*. When the performance-button detection switch 17*a* detects the pushing by the player, further performances are executed in response to this pushing.

The pachinko unit 100 is equipped with an audio output unit 18 including a speaker which is not shown in FIG. 2 (see FIG. 5), so that audio performance is executed in addition to the aforementioned various performances.

In addition, on the lower right side of the playfield 6*a* are provided a first special-symbol display device 19, a second special-symbol display device 20, a normal-symbol display device 21, a first special-symbol-reserve display light 22, a second special-symbol-reserve display light 23, and a normal-symbol-reserve display light 24.

The first special-symbol display device 19 is provided for notification of the result of a jackpot lottery carried out in response to the entering of a playing ball into the first start-up hole 9. The first special-symbol display device 19 is equipped with a seven-segment LED display. Specifically, a plurality of special symbols corresponding to the results of a jackpot lottery are stored. The first special-symbol display device 19 is controlled to display a special symbol corresponding to the result of jackpot lottery in order to notify the player of the lottery result. For example, the first special-symbol display device 19 displays the numeral "7" when a jackpot is hit, and displays the symbol "-" when a jackpot is missed. Such displayed numeral "7" and symbol "-" correspond to the special symbols. Such symbols are not displayed immediately, but stopped and displayed after a predetermined time-period of variable displaying operation.

Here, the term "jackpot lottery" means the processing of determining whether or not a random number value for determining a special symbol, which has been acquired at the time when a playing ball enters the first start-up hole 9, corresponds to a jackpot. The player is not immediately notified of the jackpot lottery result thus obtained. Instead, the first special-symbol display device 19 produces a variable display such as a blinking display of the special symbols. Then, upon the lapse of a predetermined time-period of the variable display, the first special-symbol display device 19 stops and displays the special symbol corresponding to the result of the jackpot lottery to notify the player of the lottery result. The second special-symbol display device 20 is provided for notification of the result of a jackpot lottery carried out in response to the entering of a playing ball into the second start-up hole 10. The second special-symbol display device 20 displays special symbols in a similar manner to the first special-symbol display device 10.

The normal-symbol display device 21 is provided for notification of the result of a lottery for a normal symbol which is carried out in response to the passage of a playing ball through the normal-symbol gate 8. The normal-symbol display device 21 lights a lamp when the lottery for the normal symbol results in a win, and then the second start-up hole 10 is controlled to be in the second mode for a predetermined time-period, which will be described in detail later.

Here, the term "lottery for a normal symbol" means the processing of determining whether or not a random number value for determining a normal symbol, which has been acquired at the time when a playing ball passes through the normal-symbol gate 8, corresponds to a win. The player is not notified of the normal-symbol lottery result thus obtained immediately after the playing ball has passed through the normal-symbol gate 8 as in the above cases. Instead, the normal-symbol display device 21 produces variable display, such as a blinking display of the normal symbols. Then, upon the lapse of a predetermined time-period of the variable display, the normal-symbol display device 21 stops and displays the normal symbol corresponding to the result of the normal-symbol lottery to notify the player of the lottery result.

If a playing ball enters the first start-up hole 9 or the second start-up hole 10 during, for example, the variable displaying operation for the special symbols or a special game described later, a jackpot lottery may not be carried out immediately. In this event, the right of a jackpot lottery is reserved under certain conditions. More specifically, a random number value for determining a special symbol acquired when a playing ball enters the first start-up hole 9 is stored as a first reserve. A random number value for determining a special symbol acquired when a playing ball enters the second start-up hole 10 is stored as a second reserve.

Regarding the first and second reserves, the upper limit number of reserved balls is set at four. The numbers of reserved balls are respectively displayed on the first special-symbol reserve display light 22 and the second special-symbol reserve display light 23. When the number of playing balls in the first reserve is one, the left LED of the first special-symbol reserve display light 22 is lit up, and when it is two, the two LEDs of the first special-symbol reserve display light 22 are lit up. When the number of playing balls in the first reserve is three, the left LED of the first special-symbol reserve display light 22 is blinked and the right LED is lit up. When the number of playing balls in the first reserve is four, both the two LEDs of the first special-symbol reserve display light 22 are blinked. The second special-symbol reserve display light 23 shows the number of playing balls in the second reserve in a similar manner to the first special-symbol reserve display light 22.

Also, the upper limit number of reserved balls for the normal symbols is set at four. The number of reserved balls is shown by the normal-symbol reserve display light 24 in a similar manner to the first special-symbol reserve display light 22 and the second special-symbol reserve display light 23.

The glass frame 110 supports a glass plate 112 that covers the front side (facing the player) of the game board 2 in such a manner as to enable the player to visually recognize the playfield 6*a*. The glass plate 112 is detachably fitted into the glass frame 110.

The glass frame 110 is coupled to an outer frame 120 through a hinge mechanism 111 on one side of the right and left sides (for example, on the left side when viewed from the front of the pachinko unit). The glass frame 110 is attached so as to be capable of pivoting about the hinge mechanism 111 in the direction such that the other side of the right and left sides (for example, the right side when viewed from the front of the pachinko unit) is separated from the outer frame 120. The glass frame 110, together with the glass plate 111, covers the game board 2, and pivots about the hinge mechanism 111 like a door, thereby opening up the inside, including the game board 2, of the outer frame 120. On this other side of the glass frame 110 a lock mechanism is mounted for locking the other side of the glass frame 110 to the outer frame 120. The locking effected by the lock mechanism can be undone by a key designed for the purpose. The glass frame 110 is also provided with a gate opening switch 30 for detecting whether or not the glass frame 110 is separated from the outer frame 120.

On the back of the pachinko unit 100 are provided a main control circuit board 101, a performance control circuit board 102, a frame control circuit board 103, a power circuit board 107, a game-information output terminal board 108 and the like. The power circuit board 107 is provided with a power plug 50 for supplying power to the pachinko unit 100 and a power switch (not shown).

(Internal Configuration of Control Means)

Figure 5:
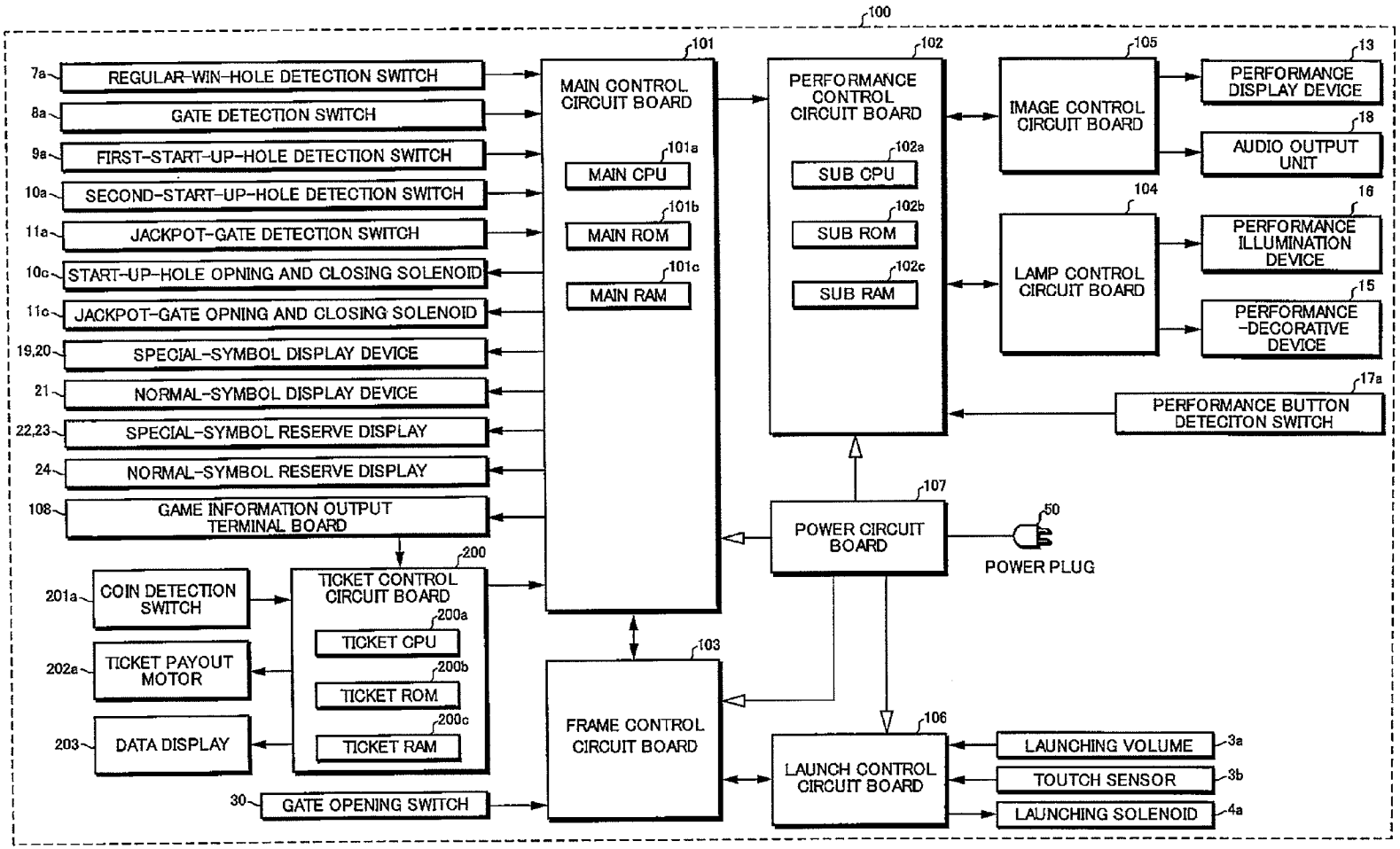
FIG. 5 is a block diagram of the entire pachinko unit.

Next, controller configured to control game process will be described using the block diagram of the entire pachinko unit in FIG. 5.

The main control circuit board 101 is main controller configured to control the basic operation of the game. The main control circuit board 101 receives a game enabling signal from the ticket control circuit board 200 and various detection signals from the first-start-up-hole detection switch 9*a* and the like. Upon the reception of the signals, the main control circuit board 101 drives the first special-symbol display device 19, a jackpot-gate opening and closing solenoid 11*c* and the like to control the game. In addition, the main control circuit board 101 determines whether or not a ticket should be paid out as a result of the game. When a ticket should be paid out, the main control circuit board 101 outputs a ticket payout signal instructing the ticket payout to the ticket control circuit board 200 via the game information output terminal board 108.

In the embodiment, the main control circuit board 101 forms the game control unit.

The main control circuit board 101 contains a main CPU 101*a*, a main ROM 101*b*, a main RAM 101*c*, main-control input ports (not shown) and main-control output ports (not shown).

The main-control input ports are connected to the ticket control circuit board 200, the frame control circuit board 103, the regular-win-hole detection switch 7*a* detecting that a playing ball enters the regular win hole 7, the gate detection switch 8*a* detecting that a playing ball passes through the gate 8, the first-start-up-hole detection switch 9*a* detecting that a playing ball enters the first start-up hole 9, the second-start-up-hole detection switch 10*a* detecting that a playing ball enters the second start-up hole 10, and the jackpot-gate detection switch 11*a* detecting that a playing ball enters the jackpot gate 11. The main control circuit board 101 receives various signals through the main-control input ports.

The main-control output ports are connected to a start-up-hole opening and closing solenoid 10*c* for activating the opening/closing operation of a pair of movable pieces 10*b* of the second start-up hole 10, the jackpot-gate opening and closing solenoid 11*c* for activating the opening/closing operation of the jackpot-gate opening-and-closing flapper 11*b*, the first and second special-symbol display devices 19 and 20 displaying the special symbols, the normal-symbol display device 21 displaying the normal symbols, the first and second special-symbol reserve display lights 22 and 23 showing the number of reserved balls for the special symbols, the normal-symbol reserve display lights 24 showing the number of reserved balls for the normal symbols, and the game information output terminal board 108 outputting an external information signal. The main control circuit board 101 outputs various signals through the main-control output ports.

The main CPU 101*a* reads a program stored in the main ROM 101*b* to perform arithmetic processing on the basis of an input signal from each detection switch or a timer. Further, the main CPU 101*a* directly controls each device or each display light or transmits a command to another circuit board in accordance with the result of the arithmetic processing. When a coin of a predetermined amount (for example, 100 yen) is inserted into the coin inlet 201, the main CPU 101*a* outputs a launch enabling signal to allow the launch control circuit board 106 to launch a playing ball through the frame control circuit board 103 until at least a predetermined game time has lapsed.

The main ROM 101*b* stores programs for controlling a game, and data and tables required for making determinations in various games.

The main ROM 101*b* stores, for example, jackpot determination tables referred to for determining whether or not a jackpot should be scored in a jackpot lottery (see FIGS. 8(*a*) and 8(*b*)), a win determination table referred to for determining whether or not a win should be scored in a normal-symbol lottery (see FIG. 8(*c*)), symbol determination tables to determine a special symbol which should be stopped as a stop symbol (see FIGS. 9(*a*) and 9(*b*)), a post-jackpot set data table referred to for determining a probability of a game state on the basis of the stop symbol data of special symbols (see FIG. 10), and the like. Specific examples of the various tables will be described later with reference to FIG. 8 and FIG. 9.

Moreover, the foregoing tables are just characteristic tables shown by way of example. A large number of other tables and programs (not shown) as well as the foregoing tables are provided for use in the game process.

The main RAM 101*c* functions as a data work area used in the arithmetic processing by the main CPU 101*a*, and includes a plurality of storage areas.

For example, the main RAM 101*c* includes a one-play timer counter, a ticket counter, an in-one-play-entered-ball counter, a one-play storage area, a launch-enabling-data storage area, a game-start-flag storage area, a normal-symbol-reserve-number (G) storage area, a normal-symbol reserve storage area, a first-special-symbol-reserve-number (U1) storage area, a second-special-symbol-reserve-number (U2) storage area, a determination storage area, a first-special-symbol storage area, a second-special-symbol storage area, a game-round number (R) storage area, an entered-ball-counter (C) storage area for a jackpot win gate, a game-state storage area, a stop-symbol-data storage area, a normal-symbol-data storage area, a performance-transmission-data storage area, a special-symbol time counter, a normal-symbol time counter, a special-game timer counter, and the like. In turn, the game-state storage area contains a high-probability-play-flag storage area, a special-symbol and jackpot processing data storage area, and a normal-symbol and prize-winning processing data storage area. Moreover, the foregoing storage areas are examples, and a large number of other storage areas as well as the foregoing storage areas are provided.

In the embodiment, the main RAM 101*c* storing the first-special-symbol storage area and the second-special-symbol storage area forms the reserve storing device.

The game information output terminal board 108 is provided for outputting an external information signal generated by the main control circuit board 101 to a hall computer installed in a pachinko parlor or the like. The game information output terminal board 108 is connected to the main control circuit board 101 with wiring, and has a connector intended for connection to a hall computer of a pachinko parlor or the like for external information.

The power circuit board 107 includes a backup power source comprising a capacitor, and supplies source voltage to the pachinko unit. The power circuit board 107 also monitors the source voltage to be supplied to the pachinko unit. When the source voltage decreases to a predetermined value or less, the power circuit board 107 outputs a power cut detection signal to the main control circuit board 101. More specifically, when the power cut detection signal changes to a high level, the main CPU 101*a* comes into the operational state. When the power cut detection signal changes to a low level, the main CPU 101*a* comes into the nonoperational state. The backup power source is not limited to a capacitor, and may be equipped with a battery, for example, or alternatively may be a combination of a capacitor and a battery.

The performance control circuit board 102 mainly controls each performance operated during a game, standby or the like. The performance control circuit board 102 is equipped with a sub-CPU 102*a*, a sub-ROM 102*b* and a sub-RAM 102*c*, and is connected to the main control circuit board 101 for one-way communication from the main control circuit board 101 to the performance control circuit board 102. The sub-CPU 102*a* reads a program stored in the sub-ROM 102*b* to perform arithmetic processing on the basis of a command transmitted from the main control circuit board 101 or an input signal from the aforementioned performance-button detection switch 17*a* or a timer. Then, based on the arithmetic processing, the sub-CPU 102*a* transmits the corresponding data to the lamp control circuit board 104 or the image control circuit board 105.

The sub-ROM 102*b* of the performance control circuit board 102 stores programs for the performance control, data and tables required for making determinations in various games.

Specifically, the sub-ROM 102*b* stores a performance pattern determination table for determining a performance pattern on the basis of a variation-pattern-specifying command received from the main control circuit board 101, a performance-symbol determination table for determining a combination of the performance symbols 30 which are stopped and displayed (see FIG. 11), and the like. Moreover, the foregoing tables are just characteristic tables shown by way of example. A number of other tables and programs (not shown) as well as the foregoing tables are provided for use in the game process.

The sub-RAM 102*c* of the performance control circuit board 102 functions as a data work area used in the arithmetic processing performed by the sub-CPU 102*a*, and includes a plurality of storage areas.

Specifically, the sub-RAM 102*c* includes a command reception buffer, a game-state storage area, a performance-pattern storage area, performance-symbol storage area, and the like. Moreover, the foregoing storage areas are examples, and a number of other storage areas as well as the foregoing storage areas are provided.

The frame control circuit board 103 controls error detection and communications between the main control circuit board 101 and the launch control circuit board 106.

The frame control circuit board 103 contains a payout CPU, a payout ROM and a payout RAM which are not shown. The frame control circuit board 103 is connected to the main control circuit board 101 for bidirectional communications with the main control circuit board 101. The payout CPU reads a program stored in the payout ROM to perform arithmetic processing on the basis of an input signal from the gate opening switch 30 or a timer. Then, based on the arithmetic processing, the payout CPU transmits the corresponding data to the main control circuit board 101. At this stage, the payout RAM functions as a data work area used in the arithmetic processing performed by the payout CPU.

Upon reception of the launch enabling signal from the main control circuit board 101, the frame control circuit board 103 outputs the received launch enabling signal to the launch control circuit board 106.

The lamp control circuit board 104 controls the turning-on of the performance illumination devices 16 mounted on the game board 2, and controls the driving of a motor used for changing the emission direction of light. In addition, the lamp control circuit board 104 controls the passage of electric current through a drive source such as a solenoid, a motor or the like operating the performance figure device 15. The lamp control circuit board 104 is connected to the performance control circuit board 102 and conducts various types of control based on the data transmitted from the performance control circuit board 102.

The image control circuit board 105 contains an image CPU, an image ROM, an image RAM, a VRAM, an audio CPU, an audio ROM, and an audio RAM which are not shown but provided for control on image display of the performance display device 13. The image control circuit board 105 is connected to the performance control circuit board 102 for bidirectional communications with the performance control circuit board 102. The output ports of the image control circuit board 105 are connected to the performance display device 13 and the audio output unit 18.

The image ROM stores a large number of performance symbols 30 and image data on background images and the like to be displayed on the performance display device 13.

The image CPU reads a predetermined program on the basis of a command transmitted from the performance control circuit board 102. The image CPU also reads predetermined image data from the image ROM into a VRAM to control the displaying on the performance display device 13. The image CPU performs various types of image processing, such as background-image display processing, performance-symbol display processing, an animation-image display device and the like, on the performance display device 13. A background image, a performance-symbol image and an animation image are superimposed and displayed on the display screen of the performance display device 13.

In other words, the performance-symbol image and the animation image are displayed in such a manner as to be shown at a less depth than the background image when viewed from the front. In this case, if the background image and the symbol image overlap each other in the same position, a known hidden surface removal technique such as a z-buffer algorism or the like is used to refer to a z value in the z-buffer for each image in the image data in order to give a priority to the symbol image and store it in the VRAM.

The audio ROM stores enormous amounts of audio data outputted from the audio output unit 18. The audio CPU reads a predetermined program on the basis of a command transmitted from the performance control circuit board 102 and controls the audio output of the audio output unit 18.

The ticket control circuit board 200 receives a coin of a predetermined amount (for example, 100 yen) which is an inserted medium inserted into the coin inlet 201. Then, the ticket control circuit board 200 outputs a game enabling signal to the main control circuit board 101 for allowing one game play. Then, the ticket control circuit board 200 drives the ticket payout motor 202*a* to pay out a ticket, and operates the data display 203 to display game information.

In the embodiment, the ticket control circuit board 200 forms the reception control unit.

The ticket control circuit board 200 contains a ticket CPU 200*a*, a ticket ROM 200*b*, a ticket RAM 200*c* and I/O ports for ticket control (not shown). The ticket-control I/O ports are connected to the main control circuit 101, the game information output terminal board 108, the coin detection switch 201*a*, the ticket payout motor 202*a*, and the data display 203. The ticket control circuit board 200 receives a coin insertion signal from the coin detection switch 201*a*, and an in-one-play signal, a ticket payout signal and a jackpot signal from the game information output terminal board 108 through the ticket control I/O ports. The ticket control circuit board 200 outputs a game enabling signal to the main control circuit board 101 through the ticket control I/O ports.

In the embodiment, a ticket control I/O port through which an in-one-play signal is received forms the in-one-play signal input device.

Upon the detection of a coin of a predetermined amount (for example, 100 yen) inserted into the coin inlet 201, the coin detection switch 201*a* outputs a coin insertion signal to the ticket CPU 200*a* through the ticket control I/O port.

In the embodiment, the coin detection switch 201*a* forms the inserted-medium detector.

Upon the reception of driving data from the ticket CPU 200*a* through the ticket control I/O port, the ticket payout motor 202*a* is driven.

The ticket CPU 200*a* reads a program stored in the ticket ROM 200*b* on the basis of the received various signals for arithmetic processing, and outputs various signals for control.

The ticket ROM 200*b* stores medal-insertion control program and data and tables which are required for various calculations.

The ticket RAM 200*c* functions as a data work area used in the arithmetic processing performed by the ticket CPU 200*a*, and includes a plurality of storage areas.

Specifically, the ticket RAM 200*c* includes a game-executing-flag storage area, a credit counter, a payout counter, a max payout counter, a bonus counter, a max bonus counter, payout timer and the like. Moreover, the foregoing storage areas are examples, and a large number of other storage areas are provided.

In the embodiment, the credit counter forms the reception information storing unit, and the ticket CPU 200*a* operating the credit counter to store data forms the storing instruction device. In addition, the payout counter and the bonus counter in the ticket RAM 200*c* form the privilege-frequency-in-one-play storing device, while the max payout counter and the max bonus counter included in the ticket RAM 200*c* form the maximum-frequency-of-privilege storing device.

The ticket CPU 200*a* operates the data display 203 to display information based on the max payout counter and the max bonus counter stored in the ticket RAM 200*c*. In this way, the data display 203 display the maximum number of payout tickets per one game play on that day and the maximum frequency of jackpots per one game play on that day.

The launch control circuit board 106 allows playing ball launches upon the reception of a launch enabling signal from the frame control circuit board 103. Then, the launch control circuit board 106 retrieve a touch signal from a touch sensor 3*b* and a voltage value from the launch volume 3*a*, and then controls the passage of electric current through the launching solenoid 4*a* to launch a playing ball.

At this stage, the rotational speed of the launching solenoid 4*a* is set at 99 (rotation/min.) from the viewpoint of a frequency based on the output period of a quartz oscillator mounted on the launch control circuit board 106. As a result, the number of playing ball launches per minute is 99 (balls/min.) because one playing ball is launched in each rotation of the launching solenoid 4*a*. That is, the playing balls are launched at about 606-ms intervals.

(Block Diagram of Launch Control Circuit Board)

Figure 6:
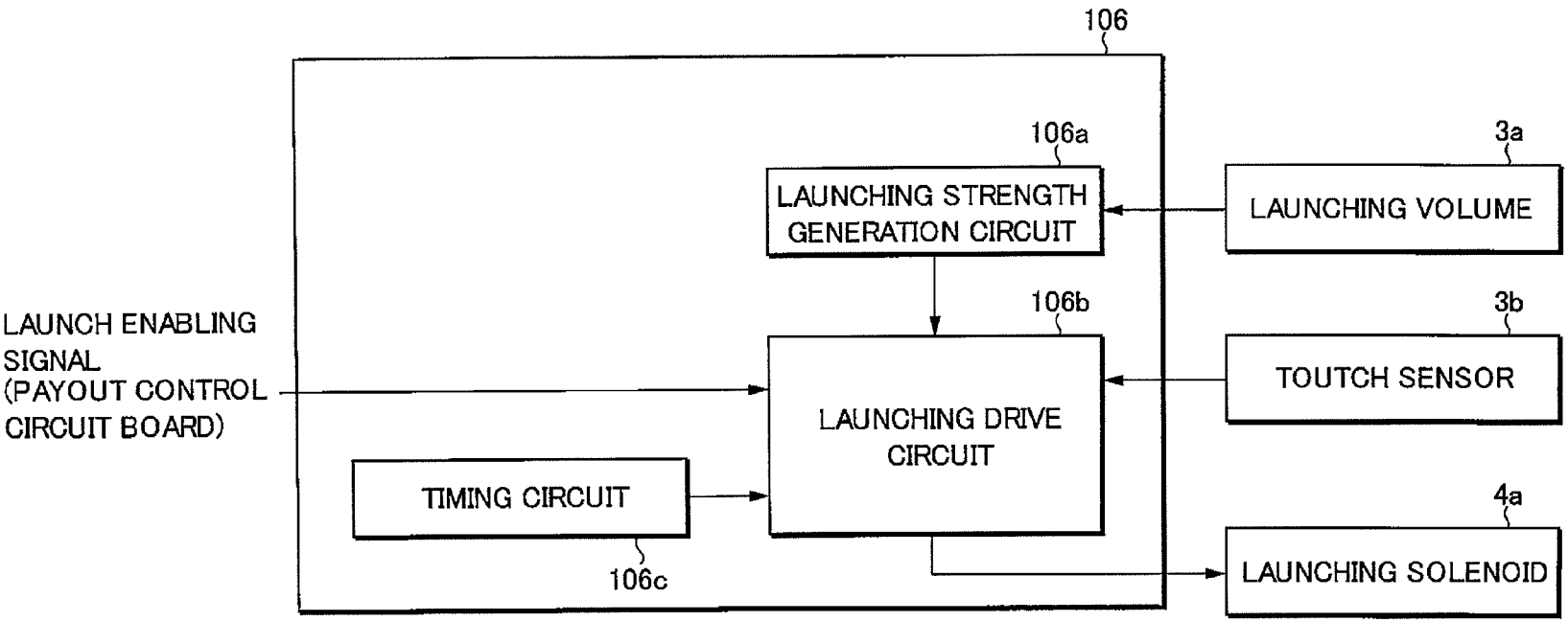
FIG. 6 is a block diagram of a launching control circuit board.

Referring next to FIG. 6, the circuit configuration of the launch control circuit board 106 will be described. As shown in FIG. 6, the launch control circuit board 106 includes, at least, a launching strength generation circuit 106*a*, launching drive circuit 106*b* and a timing circuit 106*c*.

The launching volume 3*a* comprising a variable resistor is applied with a constant voltage (e.g., 5V), so that the launching strength generation circuit 106*a* is supplied with the voltage divided by the variable resistor on the basis of a resistance changed in accordance with a rotational angle of the operating handle 3.

The launching strength generation circuit 106*a* is supplied with the voltage from the launching volume 3*a*. Then, based on the supplied voltage, the launching strength generation circuit 106*a* generates a current for use in the launching operation in direct proportion to the supplied voltage, and then applies the generated current for the launching operation to the launching drive circuit 106*b*.

The timing circuit 106*c* includes a quartz oscillator, and outputs 99 pulse signals per minute, to the launching drive circuit 106*b*.

The launching drive circuit 106*b* receives an electric-current for use in the launching operation from the launching strength generation circuit 106*a*, a pulse signal from the timing circuit 106*c*, and a touch signal from the touch sensor 3*b*, and a launch enabling signal from the main control circuit board 101 through the frame control circuit board 103. The launching drive circuit 106*b* is configured to excite the launching solenoid 4*a* only when receiving at least both the touch signal and the launch enabling signal.

When at least both the touch signal and the launch enabling signal are applied, the launching drive circuit 106*b* excites the launching solenoid 4*a* by instantly passing the launching current outputted from the launching strength generation circuit 106*a* through the launching solenoid 4*a* on each reception of a pulse signal from the timing circuit 106*a*. In this way, 99 playing balls are launched for one minute.

(Launching Strength of Playing Ball)

Figure 7:
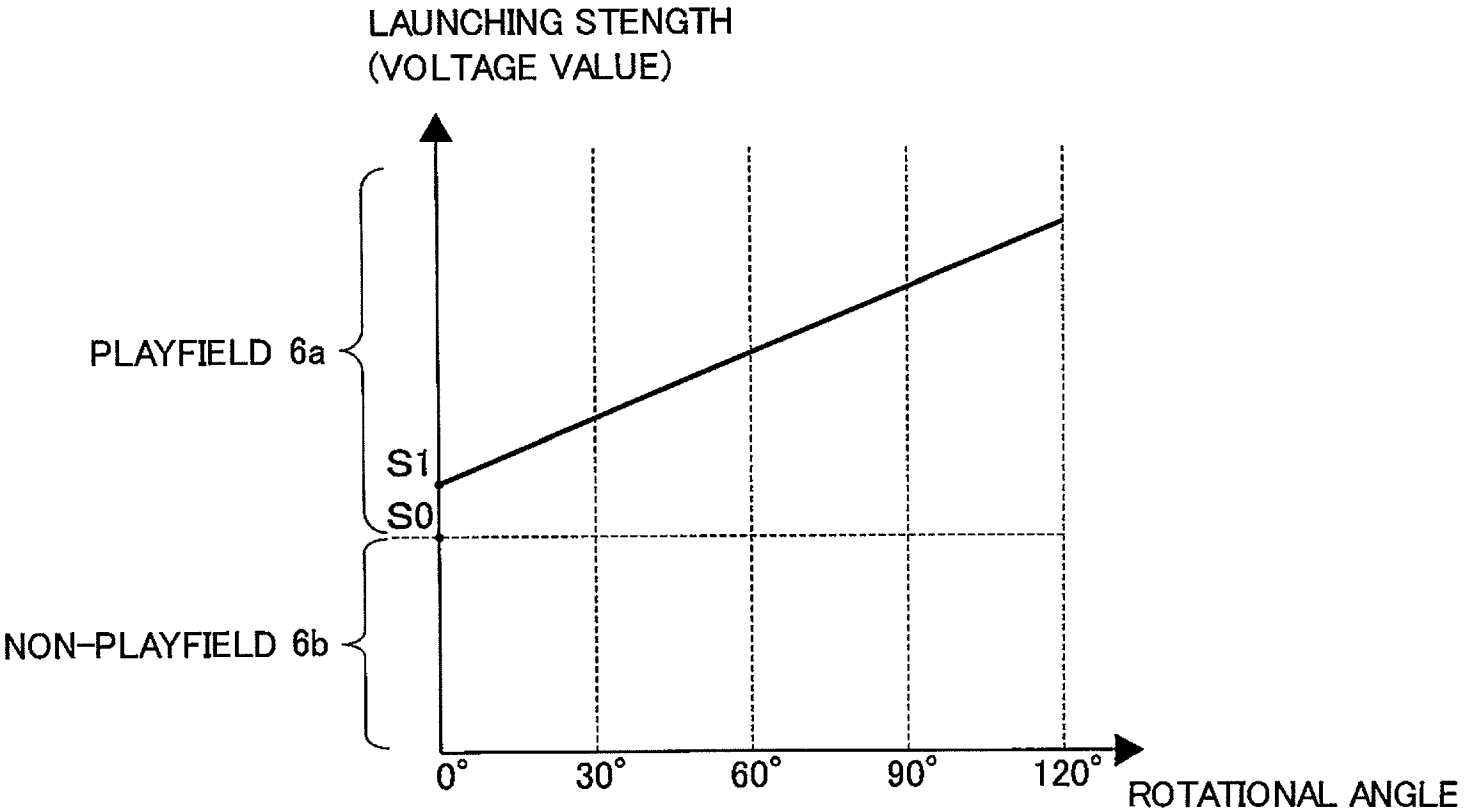
FIG. 7 is a graph showing the rotational angle and the launching strength of an operating handle.

Next, a carry of the launched ball will be described. FIG. 7 is a graph showing the relationship between the launching strength corresponding to the carry of the launched ball and the rotational angle of the operating handle 3.

As described above, the rotation of the operating handle 3 effects a change in the resistance caused by the launching volume 3*a* comprising a variable resistor. Then, a divided voltage is applied to the launching strength generation circuit 106*a*.

At this stage, accurately speaking, a current value based on a voltage value determines a launching strength of a playing ball. However, since the launching current value thus produced is in direct proportion to the voltage value supplied from the launching strength generation circuit 106*a*, it eventually results in that a launching strength is determined on the basis of the supplied voltage value.

As illustrated in FIG. 7, the variable resistor of the launching volume 3*a* in the embodiment is set such that the voltage value applied to the launch control circuit board 106 increases with increases in the rotational angle of the operating handle 3.

The launching strength S0 on the launching strength axis shown in FIG. 7 corresponds to a point at which a launching ball reaches the playfield 6*a*. The launched strength S1 corresponds to a minimum voltage value in the variable resistor of the launching volume 3*a* in the embodiment.

Here, since the launching strength S0 is smaller than the launching strength S1, when the operating handle 3 is rotated to launch a playing ball, the launched ball certainly reaches the playfield 6*a* unless any trouble occurs. For this reason, the minimum value of the launching strength has already exceeded a value corresponding to the reach point in the playfield. This eliminates the event of returning the playing ball launched during a predetermined game time-period without reaching the playfield (briefly, eliminates occurrence of a foul ball), thus making it possible to eliminate wasting time for launching.

In the embodiment, the variable resistor of the launching volume 3*a* is set such that the launching strength S1 is larger than the launching strength S0. However, instead of this, the variable resistor of the launching volume 3*a* may be set such that the launching strength S1 is equal to or lager than the launching strength S0. However, when the launching strength S0 is equal to the launching strength S1, there may be a rare case in which a playing ball reaches an area close to the playfield 6*a* but cannot enter the playfield 6*a* due to an error caused by structure deterioration of the launching device. For this reason, the launching strength S1 is preferably larger than the launching strength S0.

The embodiment has described the structure in which, even when the operating handle 3 is slightly rotated from zero degrees, a playing ball is launched. However, a slight amount of play may be provided in the rotation of the operating handle 3 so that a playing ball may be launched when the operating handle 3 is rotated greater than about 5 degrees. In any case, the launching strength corresponding to the minimum voltage value in the variable resistor of the launching volume 3*a* is required to be equal to or more than the launching strength S0.

In the embodiment the launching volume 3*a* and the launching strength generation circuit 106*a* form the launching strength determination device.

(Various Tables)

Referring next to FIG. 8 to FIG. 10, various tables stored in the main ROM 101*b* will be described in detail. After that, various tables stored in the sub-ROM 102*b* will be described in detail with reference to FIG. 11.

(Jackpot Determination Table)

Jackpot determination tables in FIG. 8(*a*) and FIG. 8(*b*) are referred to for determining whether or not a jackpot should be scored in a "jackpot lottery". The jackpot determination table in FIG. 8(*a*) is referred to by the first special-symbol display device 19, while the jackpot determination table in FIG. 8(*b*) is referred to by the second special symbol display device 20.

The main CPU 101*a* refers to the jackpot determination table to determine whether a "jackpot" or a "loss" should be scored, based on a possibility game state and the acquired random number values for determining special symbols. For example, according to the jackpot determination table for the first special symbol display device illustrated in FIG. 8(*a*), in the low probability game state, it is determined that the two numbers "o" and "1" of the random number values for determining special symbols correspond to jackpots and the 126 numbers "2" to "127" of the random number values correspond to "loss". On the other hand, in the high probability game state, it is determined that all the random number values for determining special symbols correspond to jackpots.

Accordingly, since the random number values for determining special symbols ranges from 0 to 127, the probability of a jackpot is one-$64^{th}$ in the low probability game state, and is one-first, that is, 100% in the high probability game state.

(Win Determination Table)

A win determination table in FIG. 8(*c*) is referred to for determining whether or not a win should be scored in a "lottery for normal symbols".

The main CPU 101*a* refers to the win determination table to determine whether a "win" or a "loss" should be scored, based on the acquired random number values for determining normal symbols. For example, according to the win determination table for the normal-symbol display device shown in FIG. 8(*c*), it is determined that the number "o" of the random number values for determining normal symbols corresponds to a win and the 7 numbers "1" to "7" correspond to losses.

Accordingly, since the random number values for determining normal symbols ranges from 0 to 7, the probability of a win is one-eighth, and the probability of a loss is seven-eighth.

(Symbol Determination Table)

FIGS. 9(*a*) and 9(*b*) show symbol determination tables for determining which special symbol is stopped and displayed. The symbol determination table in FIG. 9(*a*) is for determining which symbol should be stopped when a jackpot occurs, while the symbol determination table in FIG. 9(*b*) is for determining which symbol should be stopped when a loss occurs.

The main CPU 101*a* refers to the symbol determination table when a jackpot occurs, to determine a kind of special symbols (stop symbol data) based on the acquired random number value for determining a symbol of a jackpot. For example, according to the symbol determination table shown in FIG. 9(*a*), when the random number values for determining a symbol for a jackpot ranges from "0" to "59" in the case of the first-special-symbol display device, "01" (first jackpot of special symbol 1) is assigned as stop symbol data. If the random number values for determining a symbol for a jackpot ranges from "60" to "99", "02" (first normal win of special symbol 1) is assigned as stop symbol data. On the other hand, when the random number values for determining a symbol for a jackpot ranges from "0" to "59" in the case of the second special symbol display device, "03" (second jackpot of special symbol 1) is assigned as stop symbol data. If the random number values for determining a symbol for a jackpot ranges from "60" to "99", "04" (second normal win of special symbol 1) is assigned as stop symbol data.

When a "loss" is determined, the main CPU 101*a* refers to the symbol determination table shown in FIG. (b), and then assigns "00" (special symbol 0) as stop symbol data.

When the variable display of the special symbols is started, a performance-symbol-specifying command is generated as special-symbol information on the basis of a determined kind of special symbols (stop symbol data). In this connection, each performance-symbol-specifying command contains 2-byte data, in which 1-byte MODE data is for identifying a category of a control command and 1-byte DATA data represents the contents (function) of the executed control command. The same can be said of the variation-pattern-specifying command and the like which will be described later.

As described later, since a post-jackpot game state (see FIG. 10) is determined by a kind of special symbols (stop symbol data), it can be said that a kind of special symbols determines a post-jackpot game state.

(Post-Jackpot Set Data Table)

FIG. 10 is a post-jackpot set data table for determining the post-jackpot game state.

The main CPU 101*a* refers to the post-jackpot set data table to determine whether the probability game state is a high probability one or a low probability one, on the basis of the stop symbol data on the special symbols. For example, according to the post-jackpot set data table shown in FIG. 10, when the first jackpot of special symbol 1 or the second jackpot of special symbol 1 (stop symbol data 01, 03) is determined, the high probability game state is determined. When the first normal win of special symbol 1 or the second normal win of special symbol 1 (stop symbol data 02, 04) is determined, the low probability game state is set.

(Performance-Symbol Determination Table)

FIG. 11 is a performance-symbol determination table referred to for determining a combination of the performance symbols 30 stopped and displayed when a jackpot is determined.

The sub-CPU 102*a* refers to the performance-symbol determination table for a jackpot shown in FIG. 11, and determines performance symbol data on the basis of the received performance-symbol-specifying command.

For example, according to the performance-symbol determination table for a jackpot shown in FIG. 11, when receiving a performance-symbol-specifying command ("E0H01H", "E1H01H") indicative of the first jackpot of special symbol 1, the second jackpot of special symbol 1 by which the high probability game state is determined, a combination of performance symbols is set such that the three numerals "7" of a red color are arranged along any one of the 8 lines. When receiving a performance-symbol-specifying command ("E0H02H", "E1H02H") indicative of the first normal win of special symbol 1, the second normal win of special symbol 1 by which the low probability game state is determined, a combination of performance symbols is set such that the three numerals "7" of a blue color are arranged along any one of the 8 lines.

As a result, the player can know from a combination of performance symbols whether the game state enters the high probability game state or the low probability game state after the jackpot.

(Description of Probability Game State)

Next, the probability game state changed in the game process will be described. The "low probability game state" and the "high probability game state" are provided in the embodiment. Moreover, the initial probability game state of the pachinko unit is set in the "low probability game state"

In the embodiment, the term "low probability game state" means that a probability of a jackpot is set at, for example, one-64$^{th}$ in a jackpot lottery carried out on condition that a playing ball has entered the first start-up hole 9 or the second start-up hole 10. On the other hand, the term "high probability game state" means that a probability of a jackpot is set at, for example, one-first (100%) in a jackpot lottery. Accordingly, a jackpot is more easily hit in the "high probability game state" than in the "low probability game state". The low probability game state is changed to the high probability game state after a jackpot game described later has been finished.

In the embodiment, the probability of a jackpot in the high probability game state is set at one-first (100%), but it is not limited to be set at one-first (100%) as long as the probability of a jackpot in the high probability game state is higher than that in the low probability game state.

(Description of Kinds of Jackpots)

In the embodiment, the term "jackpot" means that the right to execute a jackpot game is given in a jackpot lottery carried out on condition that a playing ball has entered the first start-up hole 9 or the second start-up hole 10.

In the "jackpot game", 8 round games are carried out for opening up the jackpot gate 11. The total time-period while the jackpot gate 11 is opened up in each round game is set at 29.5 seconds at maximum. During the time-period, if a predetermined number of balls (e.g., 5 balls) enter the jackpot gate 11, one round game is finished. That is, the "jackpot game" allows the player to win a large number of tickets, because the player wins a ticket whenever a playing ball enters the jackpot gate 11 and also many balls enter the jackpot gate 11 at a time.

Next, the game process in the pachinko unit 100 will be described using flowcharts.

(Main Processing of Main Control Circuit Board)

Figure 12:
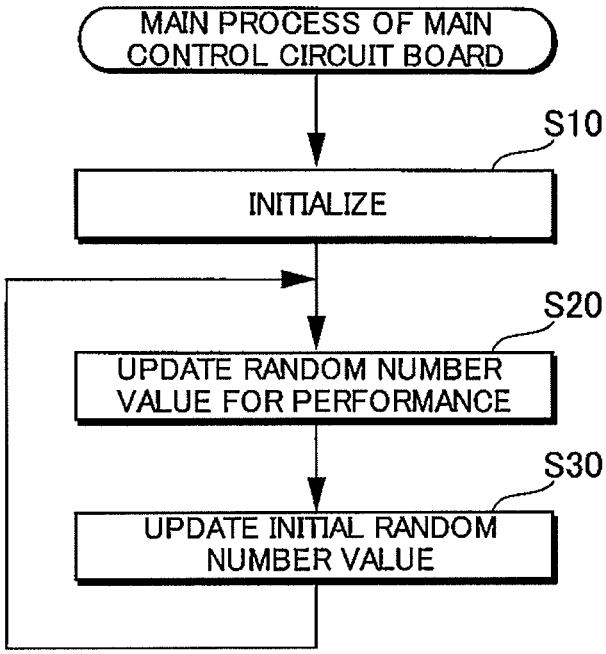
FIG. 12 is a flowchart showing the main processing carried out in a main control circuit board.

Referring first to FIG. 12, the main processing of the main control circuit board 101 will be described.

The power circuit board 107 turns the power on, which then triggers a system reset of the main CPU 101*a*. The main CPU 101*a* performs the following main processing.

First, at step S10, the main CPU 101*a* performs initialization processing. In this initialization processing the main CPU 101*a* retrieves a start-up program from the main ROM upon the power-on, and performs processing for initializing flags and the like stored in the main RAM.

At step S20, the main CPU 101*a* updates random number value for performance used for determining special symbol variation mode.

At step S30, the main CPU 101*a* updates initial random number values for respectively determining a special symbol, a jackpot symbol and a normal symbol. Subsequently, the processing in step 20 and the processing in step 30 are repeated until predetermined interrupt processing is performed.

(Timer Interrupt Processing of Main Control Circuit Board)

Figure 13:
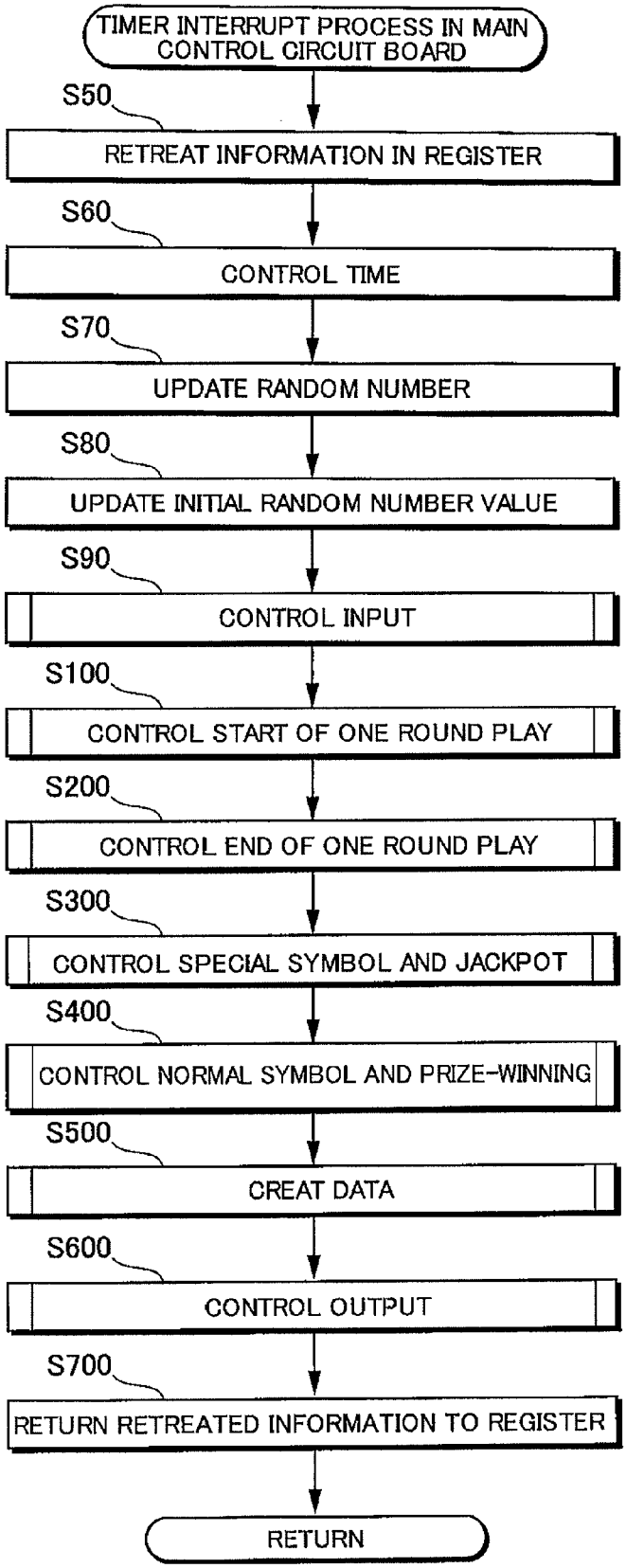
FIG. 13 is a flowchart showing the timer interrupt processing carried out in the main control circuit board.

Referring next to FIG. 13, the timer interrupt processing of the main control circuit board 101 will be described.

To execute the following timer interrupt processing, a clock pulse generation circuit for resetting which is mounted on the main control circuit board 101 generates a clock pulse at predetermined intervals (every 4 ms).

First, at step S50, the CPU 101*a* retreats the information stored in a register of the main CPU 101*a* into a stack region.

At step S60, the main CPU 101*a* performs time-period control processing for updating a variety of timer counters, such as update processing of a one round play timer/counter, update processing of a special symbol time counter, update processing of a special game timer/counter for measuring the open time of a special electrically-movable-win-hole device, i.e., jackpot gate and the like, update processing of a normal symbol time counter, and update processing of open time counter of a normal electrically-movable-win-hole device. Specifically, the one round play timer/counter, the special symbol time counter, the special game timer/counter, the normal symbol time counter and the open time counter of a normal electrically-movable-win-hole device are each decremented by 1 in the update processing.

At step S70, the CPU 101*a* performs processing of updating a random number value for determining a special symbol, a random number value of a jackpot symbol, and a random number value for determining a normal symbol.

Specifically, each of the random number values and each of the random number counters are updated by being incremented by +1. When the random number counter incremented by +1 exceeds the maximum value in the random number range (i.e., when going the full circle of the random number counter), the random number counter is reset to zero, and the random number value is newly updated from the initial random number value at that time.

At step S80, similarly to step S30, the main CPU 101*a* updates initial random number values for determining a special symbol, a jackpot symbol and a normal symbol.

At step S90, the main CPU 101*a* performs input control processing. In this processing, the CPU 101*a* determines whether or not it has received an input from each of the switches, namely, the regular-win-hole detection switch 7*a*, the jackpot-gate detection switch 11*a*, the first-start-up-hole detection switch 9*a*, the second-start-up-hole detection switch 10*a* and the gate detection switch 8*a*.

Specifically, when receiving each of the various detection switches from the regular-win-hole detection switch 7*a*, the jackpot-gate detection switch 11*a*, the first-start-up-hole detection switch 9*a* and the second-start-up-hole detection switch 10*a*, the main CPU 101*a* updates the ticket counter for pay out a ticket by adding one to the ticket counter, and also updates the in-one-play-entered-ball counter for managing the number of playing-balls entering a win-hole in one play by adding one to the in-one-play-entered-ball counter. In addition, when receiving a detection signal from the first-start-up-hole detection switch 9*a* or the second-start-up-hole detection switch 10*a*, the main CPU 101 obtains random number values for determining a special symbol, a jackpot symbol and performance, and stores the obtained random number values in the first special symbol storage area or the second special symbol storage area. Likewise, when receiving a detection signal from the gate detection switch 8*a*, the main CPU 101*a* obtains random number values for determining a normal symbol and stores them in the normal-symbol reserve storage area. Details will be described later using FIG. 14.

At step S100, upon the reception of a game enabling signal from the ticket control circuit board 200, the main CPU 101*a* performs one-round-play-start control processing for setting predetermined data required for starting one game round-play. The one-round-play-start control processing will be concretely described later using FIG. 16.

At step S200, the main CPU 101*a* performs one-round-play-quitting control processing for setting predetermined data required for quitting one game round-play. The one-round-play-quitting control processing will be concretely described later using FIG. 17.

At step S300, the main CPU 101*a* performs special-symbol-and-jackpot control processing for controlling a jackpot lottery, a jackpot gate and a game state. Details will be described later using FIG. 18.

At step S400, the main CPU 101*a* performs normal-symbol-and-prize-winning control processing for controlling a lottery for a normal symbol and a normal electrically-movable-win-hole device. Details will be described later using FIG. 20.

At step S500, the main CPU 101*a* performs data creation processing to generate a ticket payout signal causing the ticket control circuit board 200 to pay out a ticket, an in-one-play signal indicative of ongoing round play, a jackpot signal indicative of a jackpot game being controlled, a launch enabling signal for allowing the launch control circuit board 106 to launch a playing ball, data required for driving the start-up-hole opening and closing solenoid 10*c*, data required for driving the jackpot-gate opening and closing solenoid 11*c*, data required for causing the special-symbol display devices 19, 20 to light up and display, data required for causing the normal-symbol display device 21 to light up and display, and data required for causing the reserve display lights 22, 23 and 24 to light up. Details will be described later using FIG. 23.

At step S600, the main CPU 101*a* performs output control processing, in which port output processing is performed to output the signals generated in step S500. The main CPU 101*a* performs display output processing to output the special-symbol display-device data, the normal-symbol display-device data, and the reserve-display data generated in step S500. In addition, the main CPU 101*a* transmits a command set in the performance-transmission data storage area in the main RAM 101*c*.

At step S700, the main CPU 101*a* returns the information retreated in step S50 to the register in the main CPU 101*a*.

(Input Control Processing)

Figure 14:
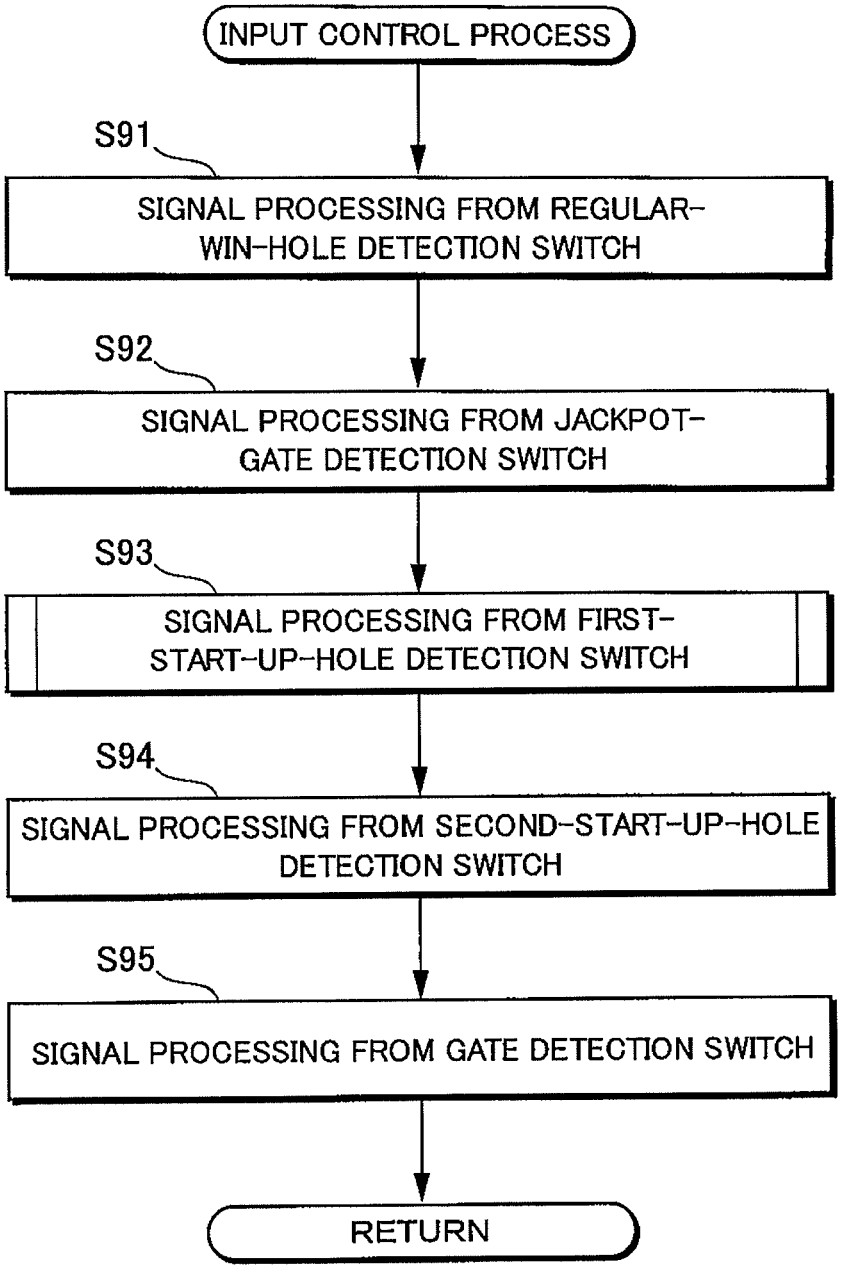
FIG. 14 is a flowchart showing the input control processing carried out in the main control circuit board.

Referring next to FIG. 14, the input control processing of the main control circuit board 101 will be described.

First, at step S91, the main CPU 101*a* determines whether or not a detection signal is received from the regular-win-hole detection switch 7*a*, that is, whether or not a playing ball enters the regular win hole 7. If determining that a detection signal is received from the regular-win-hole detection switch 7*a*, the main CPU 101*a* updates the ticket counter for paying out a ticket by adding one to the ticket counter, and similarly updates the in-one-play-entered-ball counter for managing the number of playing balls entering the win hole during one game round-play by adding one to the in-one-play-entered-ball counter.

At step S92, the main CPU 101*a* determines whether or not a detection signal is received from the jackpot-gate detection switch 7*a*, that is, whether or not a playing ball enters the jackpot gate 11. If determining that a detection signal is received from the jackpot-gate detection switch 11*a*, the main CPU 101*a* updates the ticket counter and the in-one-play-entered-ball counter by adding one to each of them. The main CPU 101*a* also updates the counter in the entered ball counter (C) storage area for the jackpot gate by adding one thereto. This entered ball counter for the jackpot gate counts the number of playing balls entered the jackpot gate 11.

At step S93, the main CPU 101a determines whether or not a detection signal is received from the first start-up-hole detection switch 9a, that is, whether or not a playing ball enters the first start-up hole 9. Then, the main CPU 101a performs the first start-up-hole detection-switch input processing for setting predetermined data used to make a jackpot determination. The first start-up-hole detection-switch input processing will be described later in detail using FIG. 15.

At step S94, the main CPU 101a determines whether or not a detection signal is received from the second start-up-hole detection switch 10a, that is, whether or not a playing ball enters the second start-up hole 10. Then, the main CPU 101a performs the second start-up-hole detection-switch input processing for setting predetermined data used to make a jackpot determination.

The second start-up-hole detection-switch input processing differs in a data storage area from the first start-up-hole detection-switch input processing described later in FIG. 15. Specifically, in the second start-up-hole detection-switch input processing the second special-symbol storage area is used instead of the first special-symbol storage area, and the second special-symbol reserve-number (U2) storage area is used instead of the first special-symbol reserve-number (U1) storage area. However, the first and the second start-up-hole detection-switch input processing are similar to each other in that a random number value for determining a special symbol, a random number value for determining a jackpot symbol and a random number value for performance are obtained and stored for the control processing.

At step S95, the main CPU 101a determines whether or not a detection signal is received from the gate detection switch 8a, that is, whether or not a playing ball passes through the normal symbol gate 8. If determining that a detection signal is received from the gate detection switch 8a, the main CPU 101a adds "1" to the normal-symbol reserve-number (G) storage area, then obtains a random number value within a preset random-number range (e.g., 0 to 10) for determining a normal symbol, and then stores the obtained random number value in the normal symbol reserve storage area. If value "4" is stored in the normal-symbol reserve-number (G) storage area, the main CPU 101a does not perform such operations of adding "1" to the normal-symbol reserve-number (G) storage area, obtaining a random number value for determining a normal symbol and storing the obtained random number value in the normal-symbol reserve storage area. When this processing is terminated, the input control processing is terminated.

In the embodiment the random number values for determining a special symbol form the determination information. In addition, the main CPU 101a performing the first start-up-hole detection switch input processing in step S93 and the second start-up-hole detection switch input processing in step S94 forms the determination information obtaining device.

(First Start-Up-Hole Detection Switch Input Processing)

Figure 15:
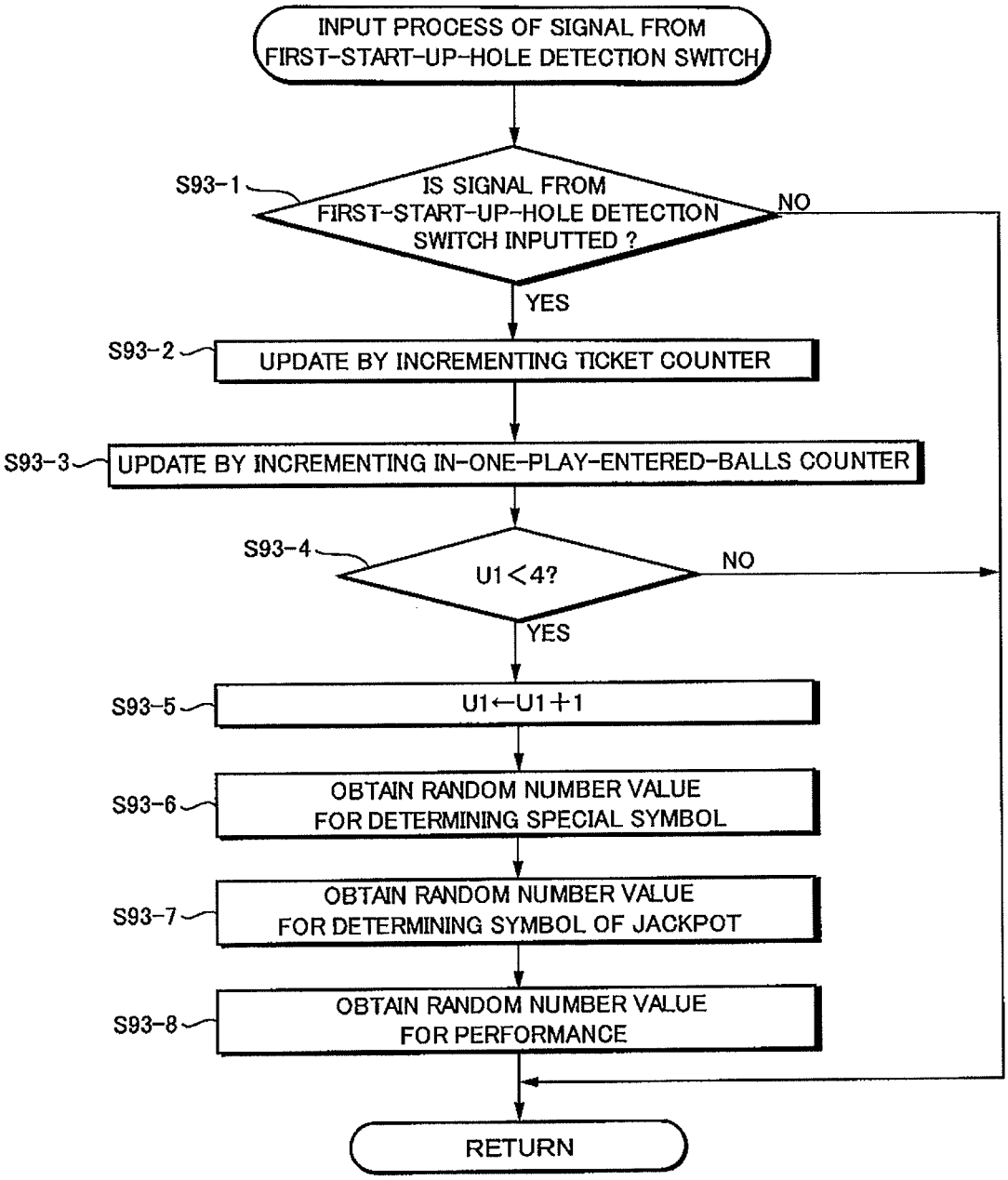
FIG. 15 is a flowchart showing the first-start-up-hole-detection-switch input processing carried out in the main control circuit board.

Referring next to FIG. 15, the first start-up-hole detection switch input processing of the main control circuit board 101 will be described.

First, at step S93-1, the main CPU 101a determines whether or not a detection signal is received from the first start-up-hole detection switch 9a.

If the main CPU 101a determines that a detection signal is received from the first start-up-hole detection switch 9a, the flow proceeds to step S93-2. If the main CPU 101a determines that a detection signal is not received from the first start-up-hole detection switch 9a, the first start-up-hole detection switch input processing is terminated.

At step S93-2, the main CPU 101a updates the ticket counter for paying out a ticket by adding 1 thereto.

At step S93-3, the main CPU 101a updates the in-one-play-entered-ball counter for managing the number of playing balls entering a win hole in one play by adding 1 thereto.

At step S93-4, the main CPU 101a determines whether or not the data set in the first special-symbol reserve-number (U1) storage area shows less than 4. When the data set in the first special-symbol reserve-number (U1) storage area shows less than 4, the flow proceeds to step S93-5. On the other hand, when the data set in the first special-symbol reserve-number (U1) storage area shows not less than 4, the first-start-up-hole detection switch input processing is terminated.

At step S93-5, the main CPU 101a adds "1" to the first special-symbol reserve-number (U1) storage area and stores the result.

At step S93-6, the main CPU 101a obtains a random number value for determining a special symbol, then searches the first special-symbol storage area in order from a first storage section to find an empty storage section, and then stores the obtained random number value for determining a special symbol in the empty storage section.

At step S93-7, the main CPU 101a obtains a random number value for determining a jackpot symbol, then searches the first special-symbol storage area in order from the first storage section to find an empty storage section, and then stores the obtained random number value for determining the jackpot symbol in the empty storage section.

At step S93-8, the main CPU 101a obtains a random number value for performance, then searches the first special-symbol storage area in order from the first storage section to find an empty storage section, and then stores the obtained random number value for performance in the empty storage section. Then, the main CPU 101a terminates the first start-up-hole detection-switch input processing.

In this manner, the random number value for determining a special symbol, the random number value for determining a jackpot symbol and the random number value for performance are respectively stored in predetermined storage sections in the first symbol-special storage area.

(One-Round-Play-Start Control Processing)

Figure 16:
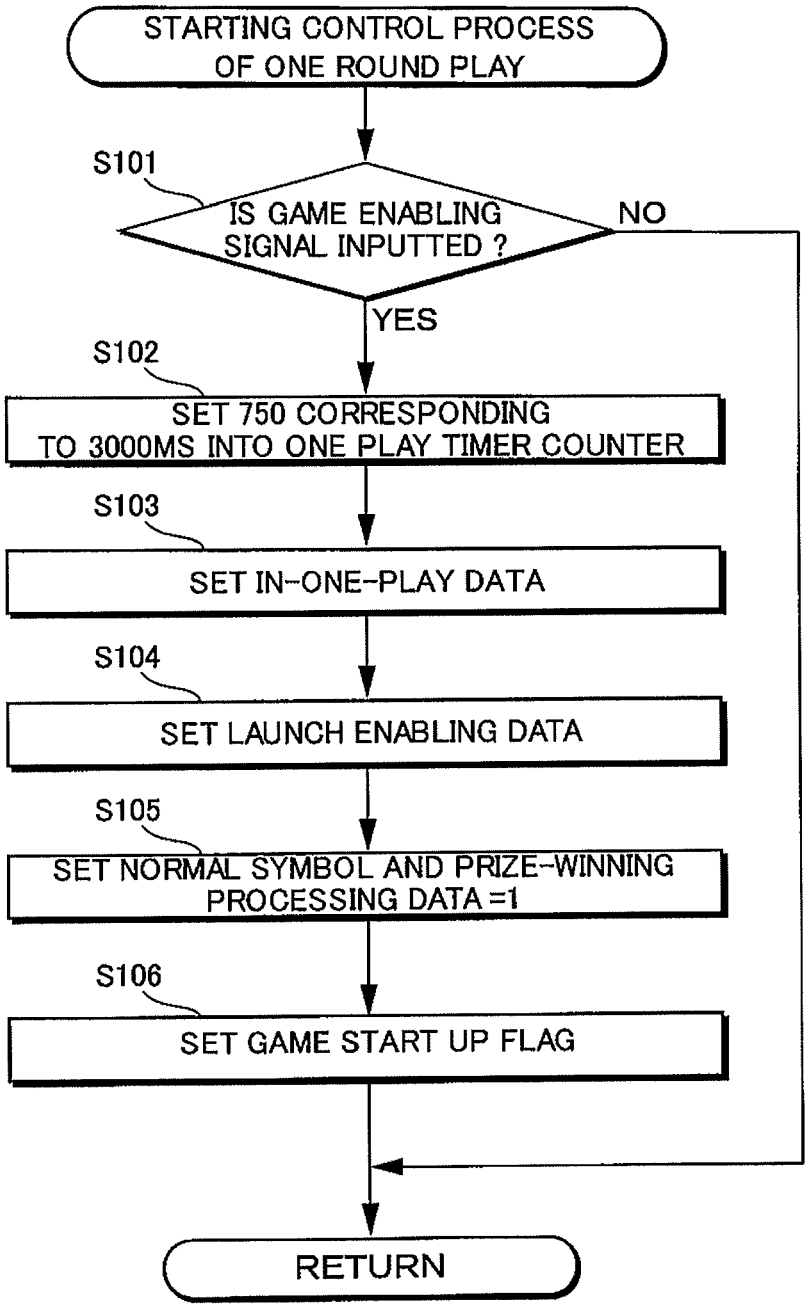
FIG. 16 is a flowchart showing the one-play start control processing carried out in the main control circuit board.

Referred next to FIG. 16, the one-round-play-start control processing of the main control circuit board 101 will be described.

At step S101, the main CPU 101a determines whether or not a game enabling signal for allowing one game round play is received from the ticket control circuit board 200. If the reception of a game enabling signal is determined, the flow proceeds to step S102, but if it is not determined, the one-round-play-start control processing is terminated.

At step S102, the main CPU 101a sets the one round play timer/counter to 750 corresponding to 3000 ms. Since the one round play timer/counter is decremented by 1 every 4 ms in step S60 as described above, the one round play timer/counter reaches zero after 3000 ms.

In the embodiment, the length of 3000 ms forms a playing period (playing time), the main CPU 101a performing the processing of setting the one round play timer/counter as a timer in step S102 and the time control processing of decrementing the one round play timer/counter in step S60 forms the playing period counter or the playing time counter.

At step S103, the main CPU 101a sets in-one-play data indicating that one game round play is being executed in the one round play storage area. When the in-one-play data is set, an in-one-play signal is generated and outputted as described later in FIG. 23 and FIG. 24.

At step S104, the main CPU 101*a* sets the launch enabling data in the launch enabling data storage area in order to allow the launch control circuit board 106 to launch a playing ball. When the launch enabling data is set, a launch enabling signal is generated and outputted as described later in FIG. 23 and FIG. 24.

At step S105, the main CPU 101*a* sets 1 as the value of the storage area for the normal symbol and prize-winning processing data required for bringing the pair of movable pieces 10*b* mounted in the second start-up hole 10 into the open state.

At the step S106, the main CPU 101*a* sets the game starting flag in the starting-up-flag storage area and terminates the one-round-play-start control processing. Details will be described later in FIG. 22. The game starting flag allows the pair of movable pieces 10*b* in the second start-up hole 10 to keep the open state until a playing ball enters any win hole.

(One Round Play Quitting Control Processing)

Referring next to FIG. 17, the one round play quitting control processing of the main control circuit board 101 will be described.

At step S201, the main CPU 101*a* determines whether or not the one round play timer/counter=0, that is, whether or not 30 seconds have lapsed since a coin of a predetermined amount was received. If the main CPU 101*a* determines that the one round play timer/counter=0, the flow proceeds to step S202, and if not, the one round play quitting control processing is terminated At step S202, the main CPU 101*a* clears the launch enabling data. Specifically, when 30 seconds have lapsed since a coin of a predetermined amount was received, the launching operation is stopped in principle.

At step S203, the main CPU 101*a* determines whether or not the ongoing round play is in a jackpot state, that is, whether or not the special symbol and jackpot processing data used in jackpot game processing as described later is set at 3. If the main CPU 101*a* determines that the ongoing round play is in a jackpot state, the flow proceeds to step S204, and if not, the flow proceeds to step S206.

At step S204, the main CPU 101*a* determines whether or not the in-one-play data is set in the one round play storage area. If the main CPU 101*a* determines that the in-one-play data is set in the one round play storage area, the flow proceeds to step S205, and if not, the one round play quitting control processing is terminated.

At step S205, the main CPU 101*a* sets launch enabling data in the launch enabling data storage area again. As a result, as long as one round play is ongoing, if the game is a jackpot game, even after a lapse of 30 seconds, the player can launch a playing ball.

At step S206, the main CPU 101*a* determines whether or not there is a reserve memory, that is, whether or not the first special symbol reserve number (U1)=0 and also the second special symbol reserve number (U2)=0. If the main CPU 101*a* does not determine that there is a reserve memory, the flow proceeds to step S207. If the main CPU 101*a* determines that there is a reserve memory, the one round play quitting control processing is terminated. As a result, as long as there is any reserve memory, the in-one-play data is not cleared in step S208 as described later, thus allowing the continuation of the one round play.

At step S207, the main CPU 101*a* determines whether or not the stop symbol data used when a loss occurs (stop symbol data "00" indicating special symbol 0) is set in the stop symbol data storage area. When determining that the stop symbol data used when a loss occurs is set, the main CPU 101*a* performs the processing in step S208, and if not, the main CPU 101*a* terminates the one round play quitting control processing.

At step S208, the main CPU 101*a* clears the in-one-play data set in the one round play storage area. As a result, the one round play ends.

At step S209, the main CPU 101*a* determines whether or not the in-one-play-entered-ball counter=0, that is, whether or not even one playing ball enters a win hole during one round play. If the main CPU 101*a* determines that the in-one-play-entered-ball counter=0, the flow proceeds to step S210, and if not, the flow proceeds to step S211.

At step S210, the main CPU 101*a* updates the ticket counter by adding 1 thereto. As a result, when no playing ball enters a win hole during the one round play, at the minimum one sheet of ticket is paid out.

In the embodiment, the payout command device is formed by the main CPU 101*a* that adds 1 to the ticket counter when the in-one-play-entered-ball counter is equal to zero after one round play has ended (step S209, step S210) and generates and outputs a ticket payout signal of one pulse to a counter which is set in the ticket counter as described later (the data creation processing shown in FIG. 23, the output control processing shown in FIG. 24).

At step S211, the main CPU 101*a* clears the in-one-play-entered-ball counter, that is, sets the in-one-play-entered-ball counter=0, and then terminates the one round play quitting control processing.

In the embodiment, the main CPU 101*a* performing the one-round-play-start control processing and the one round play quitting control processing for setting and clearing the in-one-play data forms the one-round-play execution device. Further, in the embodiment, the main CPU 101*a* performing the one-round-play-start control processing and the one round play quitting control processing for setting and clearing the launch enabling data forms the launch operation active determination device.

(Special Symbol and Jackpot Control Processing)

Figure 18:
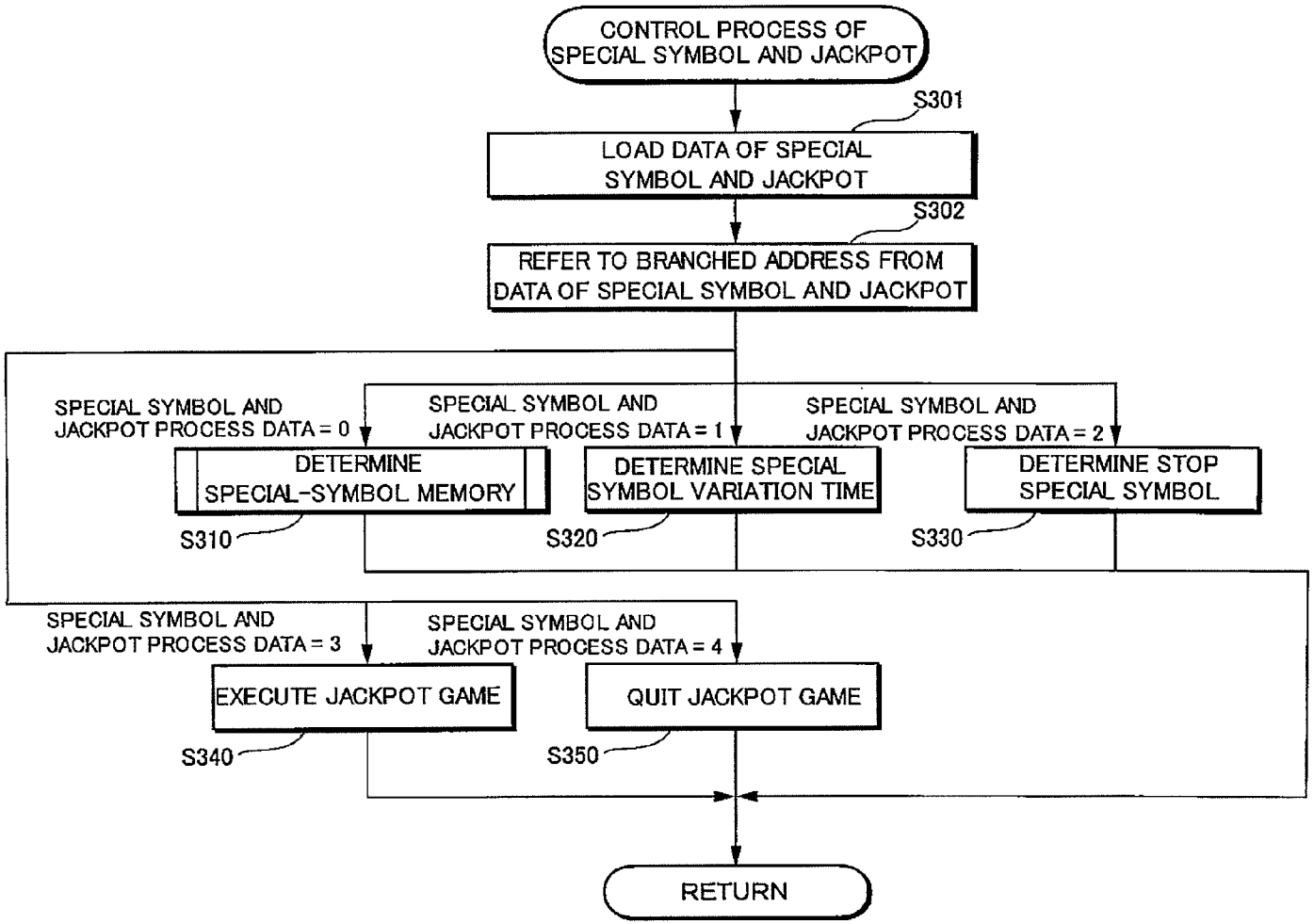
FIG. 18 is a flowchart showing a special-symbol and jackpot control processing carried out in the main control circuit board.

Referring next to FIG. 18, the special symbol and jackpot control processing of the main control circuit board 101 will be described.

At step S301, the main CPU 101*a* loads a value in the special symbol and jackpot processing data, and refers to branched addresses from the special symbol and jackpot processing data loaded at step S302. Then, when the special symbol and jackpot processing data=0, the flow proceeds to step S310 to execute the special symbol memory determination processing. When the special symbol and jackpot processing data=1, the flow proceeds to step S320 to execute the special symbol variation processing. When the special symbol and jackpot processing data=2, the flow proceeds to step S330 to execute the special symbol stop processing. When the special symbol and jackpot processing data=3, the flow proceeds to step S340 to execute the jackpot game processing. When the special symbol and jackpot processing data=4, the flow proceeds to step S350 to execute the jackpot game quitting processing.

The "special symbol and jackpot processing data" is set as necessary in each subroutine in the special symbol and jackpot control processing as described later, so that a necessary subroutine is executed as appropriate in the game.

At step S310, the main CPU 101*a* performs the special symbol memory determination processing for determining a special symbol representing a jackpot lottery or stop, which will be described in detail later using FIG. 19.

In the special symbol variation processing in step S320, the main CPU 101*a* determines whether or not the time of varying the special symbol has lapsed.

Specifically, the main CPU 101*a* determines whether or not the time of varying the special symbol determined in step S310 has lapsed (whether or not the special symbol time counter=0). If determining that the time of varying the special symbol has not lapsed, the main CPU 101*a* terminates this special symbol variation processing while reserving the special symbol and jackpot processing data=1, whereupon the next subroutine runs.

If determining that the time of varying the special symbol has lapsed, the main CPU 101*a* clears the special symbol variation display data, and stops and displays the special symbol determined in step S310 on the first special-symbol display device 19 or the second special-symbol display device 20. As a result, the special symbol is stopped and displayed on the first special-symbol display device 19 or the second special symbol display device 20 to notify the player of the result of jackpot determination.

At the end, the setting is changed from the special symbol and jackpot processing data=1 to the special symbol and jackpot processing data=2 for the purpose of starting the special symbol stop processing, followed by termination of the special symbol variation processing.

In the special symbol stop processing in step S330, the main CPU 101*a* determines the stopped and displayed special symbol.

Specifically, the main CPU 101*a* first determines whether or not the stopped and displayed special symbol is a jackpot symbol. If determining it is a jackpot symbol, the main CPU 101*a* resets the probability game state and changes the setting from the special symbol and jackpot processing data=2 to the special symbol and jackpot processing data=3 for the purpose of starting the jackpot game processing, followed by termination of the special symbol stop processing.

On the other hand, if the CPU 101*a* determines that the stopped and displayed special symbol is not a jackpot symbol, the special symbol and jackpot processing data=2 is changed to the special symbol and jackpot processing data=0 for the purpose of starting the special symbol memory determination processing, followed by termination of the special symbol stop processing.

In the jackpot game processing in step S340, the main CPU 101*a* drives the jackpot-gate opening and closing solenoid 11*c* to open the jackpot gate 11.

Specifically, the main CPU 101*a* outputs drive data for the jackpot-gate opening and closing solenoid 11*c* in order to open the jackpot-gate opening-and-closing flapper 11*b*. In addition, the main CPU 101*a* sets the special game timer/counter at 29.5 seconds for the opening time so that the jackpot-gate opening-and-closing flapper 11*b* can be opened for 29.5 second at a maximum. When a predetermined number of playing balls enter the jackpot gate 11 during this opening time (for example, a jackpot-gate-entered-ball counter=5?) or when the maximum opening time has lapsed (the special game timer/counter=0), the main CPU 101*a* stops the output of the drive data for the jackpot-gate opening and closing solenoid 11*c* to close the jackpot-gate opening-and-closing flapper 11*b*. In this manner, one round game ends. The round game control is repeated 15 times.

After the 15 round games have been operated, the setting is changed from the special symbol and jackpot processing data=3 to the special symbol and jackpot processing data=4 for the purpose of starting the jackpot game quitting processing, followed by termination of the jackpot game processing.

In the embodiment, the main CPU 101*a* performing the jackpot game processing forms the special game controller. In the embodiment, when the main CPU 101*a* performing the jackpot lottery processing of determining a jackpot is defined as privilege determination device, the main CPU 101*a* performing the jackpot game processing forms the privilege giving device. When the main CPU 101*a* performing the input control processing of determining whether or not a playing ball enters a predetermined win hole is defined as privilege determination device, the ticket CPU 200*a* paying out a ticket forms the privilege giving device.

In the jackpot game quitting processing in step S350, the main CPU 101*a* determines a probability game state.

Specifically, the main CPU 101*a* refers to the post-jackpot condition data table shown in FIG. 10, and determines, based on the kind of the jackpot symbol, whether the probability game state should be the high probability game state or the low probability game state. Then, the main CPU 101*a* sets the data indicating the probability game state thus determined in the high-probability-play-flag storage area. Subsequently, the setting is changed from the special symbol and jackpot processing data=4 to the special symbol and jackpot processing data=0 for the purpose of starting the special symbol memory determination processing, followed by termination of the jackpot game quitting processing.

In the embodiment, the main CPU 101*a* performing the jackpot game quitting processing of determining the high probability game state forms the probability increase determination device.

(Special Symbol Memory Determination Processing)

Figure 19:
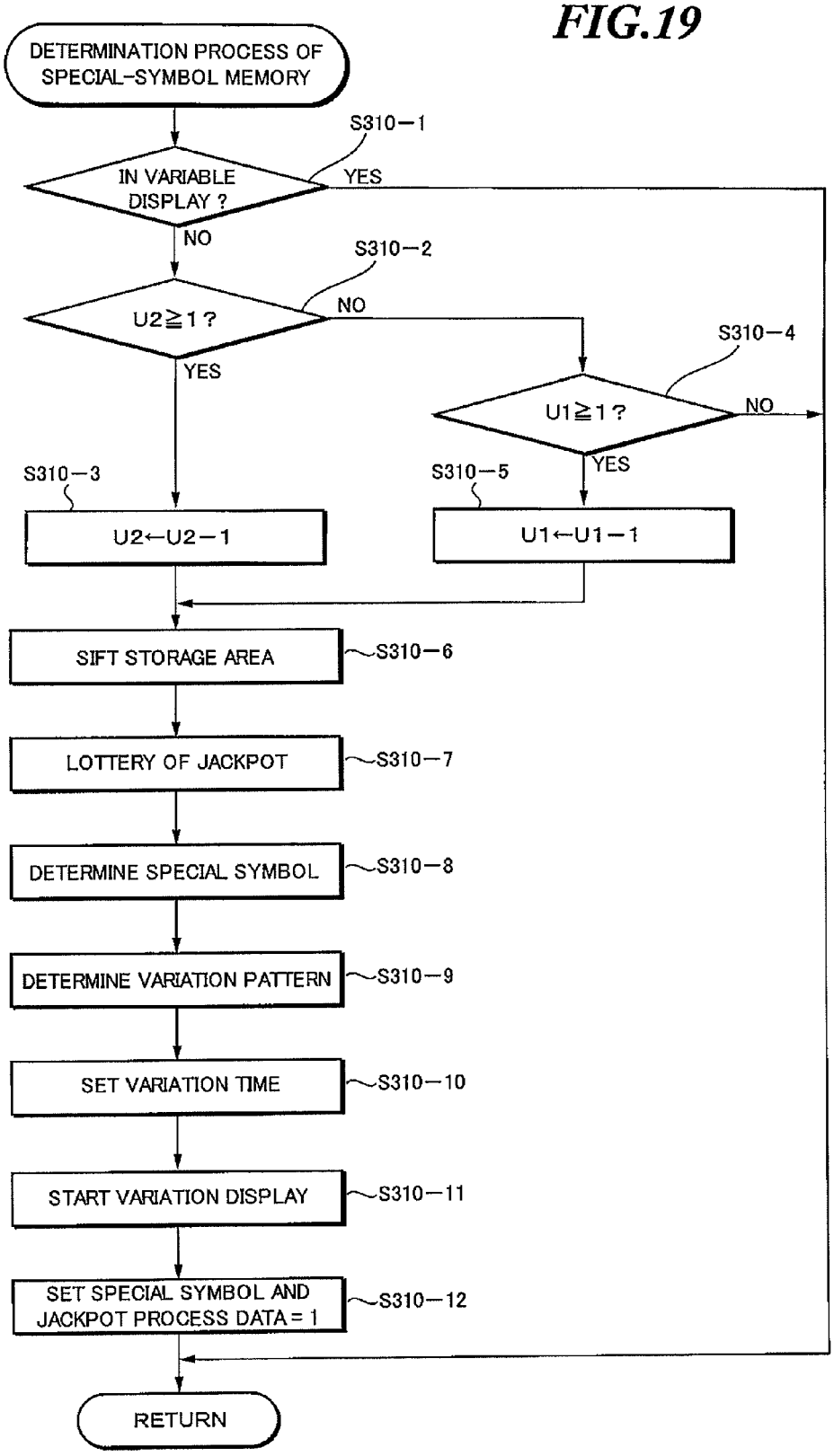
FIG. 19 is a flowchart showing the special symbol storage determination processing carried out in the main control circuit board.

Referring next to FIG. 19, the special symbol memory determination processing of the main control circuit board 101 will be described.

At step S310-1, the main CPU 101*a* determines whether or not the special symbols are being variably displayed. At this stage, if the special symbols are being variably displayed (the special symbol time counter≠0), the special symbol memory determination processing is terminated. If the special symbols are not variably displayed (the special symbol time counter=0), the flow proceeds to step S310-2.

At step S310-2, the main CPU 101, when the special symbols are not variably displayed, determines whether or not the value in the second special-symbol reserve-number (U2) storage area is 1 or more.

If the main CPU 101*a* determines that the value in the second special-symbol reserve-number (U2) storage area is 1 or more, the flow proceeds to step S310-3. If the main CPU 101*a* determines that the value in the second special-symbol reserve-number (U2) storage area is not 1 or more, the flow proceeds to step S310-4.

At step S310-3, the main CPU 101*a* subtracts 1 from the value stored in the second special-symbol reserve-number (U2) storage area, and stores the value thus obtained.

At step S310-4, the main CPU 101*a* determines whether or not the value in the first special-symbol reserve-number (U1) storage area is 1 or more.

If the main CPU 101*a* determines that the value in the first special-symbol reserve-number (U1) storage area is 1 or more, the flow proceeds to step S310-5. If the main CPU 101*a* determines that the value in the first special-symbol reserve-number (U1) storage area is not 1 or more, the special symbol memory determination processing is terminated.

At step S310-5, the main CPU 101*a* subtracts 1 from the value stored in the first special-symbol reserve-number (U1) storage area, and stores the value thus obtained.

At step S310-6, the main CPU 101*a* performs processing for shifting the data stored in the special symbol reserve storage area corresponding to the special-symbol reserve-number (U) storage area after the subtraction in step S310-2 to step S310-5. Specifically, the data stored in each of the first to fourth storage sections included in the first special symbol storage area or the second special symbol storage area is shifted to the immediately preceding storage section. At this stage, the data stored in the first storage section is shifted to the determination storage area (zeroth storage section). In this case, the data stored in the first storage section is written into the determination storage area (zeroth storage section), and the data already written in the determination storage area (zeroth storage section) is erased from the special symbol reserve storage area. In this manner, the random number value for determining a special symbol, the random number value for determining a jackpot symbol, and the random number value for performance, which have been used in the last game, are erased.

In the embodiment, the shifting is performed in the second special symbol storage area in priority to the first special symbol storage area in step S310-2 to step S310-6. However, the shifting may be performed in the first special symbol storage area or the second special symbol storage area in the order of entrance into the start-up hole. The shifting may be performed in the first special symbol storage area in priority to the second special symbol storage area.

At step S310-7, the main CPU 101*a* performs the jackpot lottery processing based on the random number value for determining a special symbol which has been written into the determination storage area (zeroth storage section) in the special symbol reserve storage area in step S310-6.

In the Jackpot lottery processing, the main CPU 101*a* refers to the jackpot determination table shown in FIG. 8, and determines whether or not the random number value for a special symbol corresponds to a "jackpot". In this connection, if the high probability game state has been determined, a greater number of random number values for determining a special symbol determined as a "jackpot" are usually set in the a jackpot lottery as compared with the case in the low probability game state. For this reason, a jackpot is more easily hit in the high probability game state than that in the low probability game state. In this embodiment, the probability rate of jackpot in the high probability game state is set at 1/1 (100%) as shown in FIGS. 8(*a*) and 8(*b*), but, of course, is not limited to this rate.

In the embodiment, the privilege determination device is formed by either the first start-up-hole detection switch 9*a* or the second start-up-hole detection switch 10*a* that detects a playing ball entering the first start-up hole 9 or the second start-up hole 10, and also the main CPU 101*a* that performs the jackpot lottery processing of determining a jackpot upon the entered-ball detection of the first start-up-hole detection switch 9*a* or the second start-up-hole detection switch 10*a*. The privilege determination device is also formed by the regular-win-hole detection switch 7*a*, the first-start-up-hole detection switch 9*a*, the second-start-up-hole detection switch 10*a* and the jackpot-gate detection switch 11*a* all of which detect a playing ball entering a predetermined win hole for ticket payout.

In addition, the special game determination device is formed by the main CPU 101*a* that performs the jackpot lottery processing.

At step S310-8, the main CPU 101*a* performs the special symbol determination processing of determining which special symbol is stopped and displayed.

In the special symbol determination processing, when determining a jackpot as a result of a jackpot lottery, the main CPU 101*a* refers to the symbol determination table shown in FIG. 9(*a*) and determines stop symbol data concerning a jackpot symbol on the basis of the random number value for determining a jackpot symbol. When determining a loss, the main CPU 101*a* refers to the symbol determination table shown in FIG. 9(*b*) to determine stop symbol data concerning a loss symbol. Subsequently, the determined stop symbol data is set in the stop symbol data storage area.

At step S310-9, the main CPU 101*a* performs the variation pattern determination processing of determining a special symbol variation mode.

In the variation pattern determination processing, the main CPU 101*a* refers to a variation pattern determination table (not shown) and determines a variation pattern on the basis of the result of the jackpot lottery, the kind of the special symbol, the special-symbol reserve number (U), and the obtained random number value for performance. Then, the main CPU 101*a* sets a variation-pattern specifying command corresponding to the variation pattern thus determined in the performance transmission data storage area.

At step S310-10, the main CPU 101*a* sets the variation time (counter value) based on the variation pattern determined in step S310-9 in the special-symbol time counter. Note that the special-symbol time counter is decremented every 4 ms in step S60 described earlier.

At step S310-11, the main CPU 101*a* performs variation-display start processing for setting the special-symbol variation display data which is used for causing the special-symbol display device 19, to produce variation display of the special symbols (LED blinking). In this manner, when the special-symbol variation display data is set, special-symbol display-device data required for blinking the LED in step S500 described earlier is created as appropriate. By output of this created data in step S600, the special-symbol display device 19, 20 produces the variation display. The variation display of the special symbols is continuously performed only for the variation time set in step S310-10.

At step S310-12, the main CPU 101*a* sets the special symbol and jackpot processing data=1. Then, the flow proceeds to step S320 to perform the special-symbol variation processing, and the special-symbol memory determination processing is terminated.

(Normal Symbol and Prize-Winning Control Processing)

Figure 20:
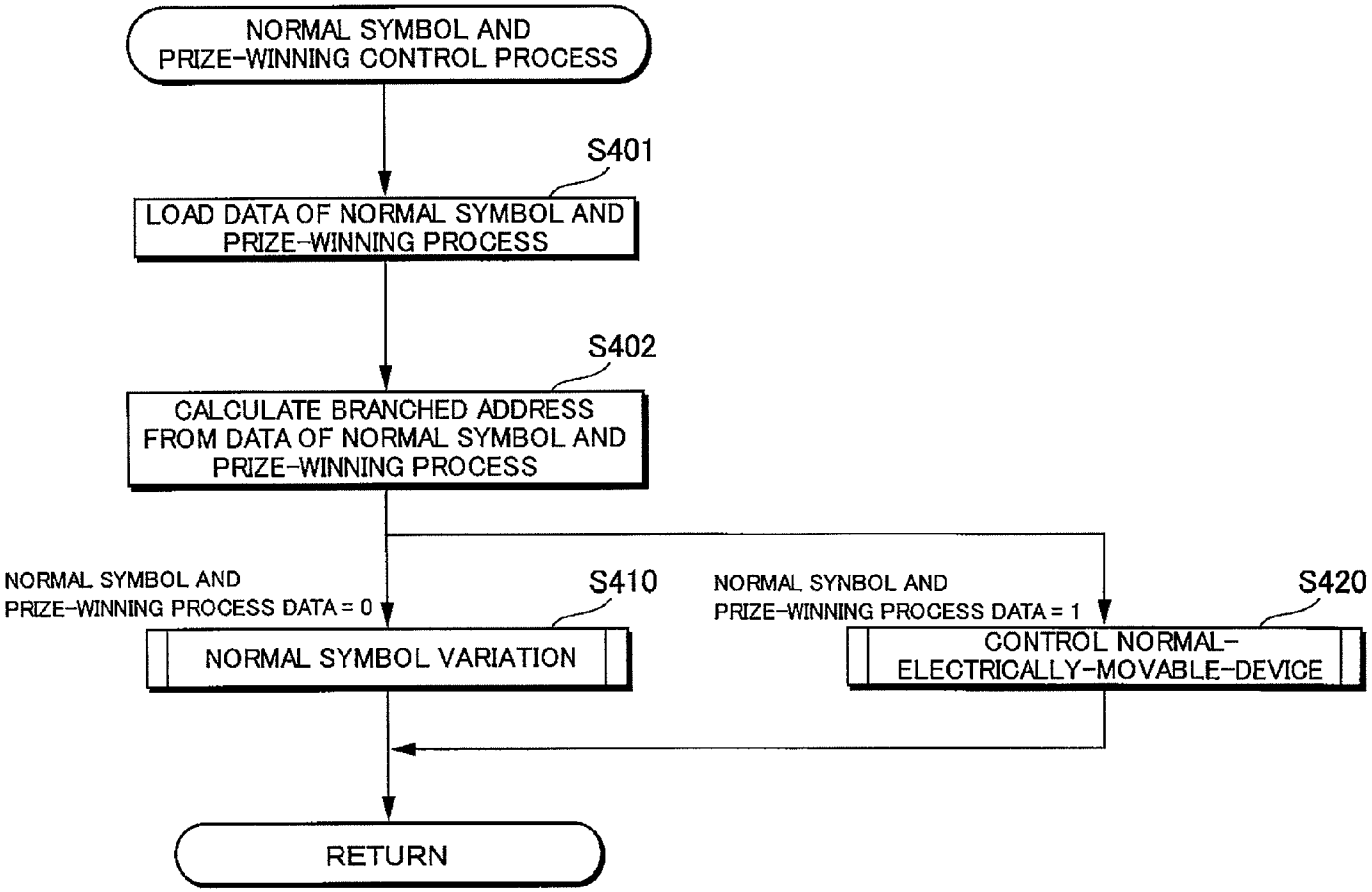
FIG. 20 is a flowchart showing a normal-symbol-and-prize-winning control processing carried out in the main control circuit board.

Referring next to FIG. 20, the normal symbol and prize-winning control processing will be described.

First, at step S401, values in the normal symbol and prize-winning processing data are loaded. At step S402, branched addresses are referred to from the normal symbol and prize-winning processing data thus loaded. As a result of the reference, if the normal symbol and prize-winning processing data=0, the flow proceeds to normal-symbol variation processing (step S410). If the normal symbol and prize-winning processing data=1, the flow proceeds to normal electrically-movable-win-hole-device control processing (step S420). Details will be described later using FIG. 21, FIG. 22.

(Normal Symbol Variation Processing)

Figure 21:
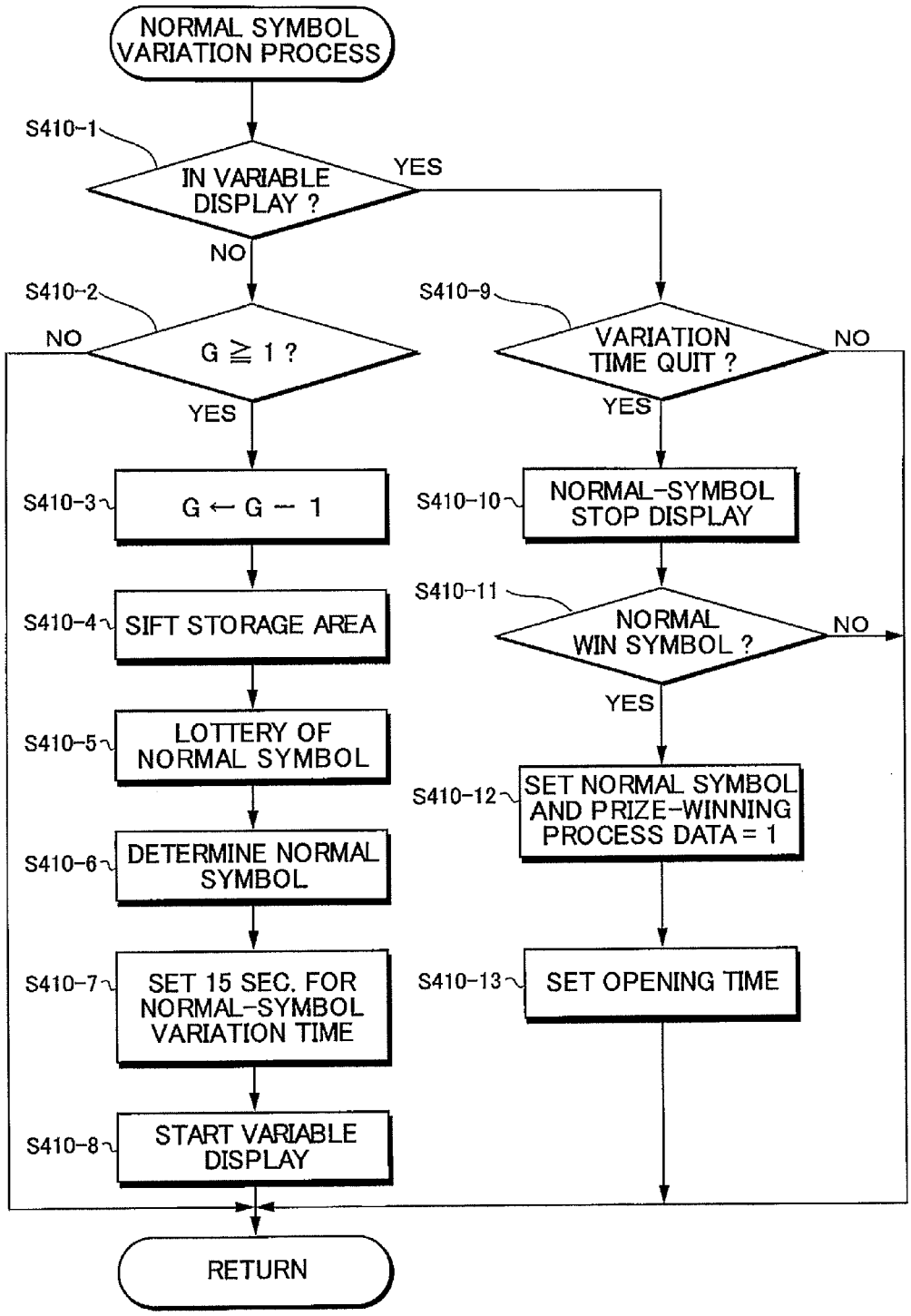
FIG. 21 is a flowchart showing the normal symbol variation processing carried out in the main control circuit board.

Referring next to FIG. 21, the normal-symbol variation processing will be described.

At step S410-1, the main CPU 101*a* determines whether or not the variation display of the normal symbols is ongoing. Specifically, the main CPU 101*a* determines whether or not the variation display data concerning the normal symbols expected to be set at step S410-8 described later is set. If the variation display of the normal symbol is ongoing, the flow proceeds to step S410-9, and if not, the flow proceeds to step S410-2.

At step S410-2, when the variation display of the normal symbol is not produced, the main CPU 101*a* determines whether the normal-symbol reserve number (G) stored in the normal-symbol reserve-number (G) storage area is equal to or more than 1. If the reserve number (G) is zero, the variation display of the normal symbols is not produced. For the reason, the normal symbol variation processing is terminated.

At step S410-3, the main CPU 101*a* updates the normal symbol reserve number (G) stored in the normal-symbol reserve-number (G) storage area by subtracting 1 from the value (G) if the main CPU 101*a* determines at step S410-2 that the normal-symbol reserve number (G) is 1 or more.

At step S410-4, the main CPU 101*a* performs processing for shifting the data stored in the normal-symbol reserve storage area. Specifically, the data stored in each of the first to fourth storage sections is shifted to the immediately preceding storage section. At this stage, the data stored in an immediately preceding storage section is written into a predetermined processing area, and erased from the normal-symbol reserve storage area.

At step S410-5, the main CPU 101*a* performs the normal-symbol lottery processing. In the normal-symbol lottery processing, the main CPU 101*a* refers to the win determination table shown in FIG. 8(*c*) and determines whether or not the random number value for determining a normal symbol corresponds to a "win". For example, with this table, since it is determined that a random number value "0" of the random number values "0" to "7" for determining a normal symbol corresponds to a win, a win is determined with a probability of one eighth.

At step S410-6, the main CPU 101*a* refers to the result of the determination made in the normal-symbol lottery processing in step S410-5. If determining a win, the main CPU 101*a* sets the data corresponding to the win symbols of the normal symbols in the normal-symbol data storage area. If determining a loss, the main CPU 101*a* sets the data corresponding to the loss symbols of the normal symbols in the normal-symbol data storage area.

At step S410-7, the main CPU 101*a* sets the variation time of the normal symbols to 15 seconds. That is, a counter of 3750 corresponding to 15000 ms is set in the normal-symbol time counter. Note that the normal-symbol time counter is decremented every 4 ms in step S90, and the normal-symbol time counter reaches zero after 15 seconds have lapsed.

At step S410-8, the main CPU 101*a* performs the variation-display start processing of setting the normal-symbol variation display data which is used for causing the normal-symbol display device 21 to produce variation display of the normal symbols (LED blinking). In this manner, when the normal-symbol variation display data is set, normal-symbol display-device data required for blinking the LED in step S500 described earlier is created as appropriate. By output of this created data in step S600, the normal-symbol display device 21 produces the variation display. The variation display of the normal symbols is continuously performed only for the variation time set in step S410-7.

When determining at step S410-1 that the variation display of the normal symbols is ongoing, the main CPU 101*a* determines at step S410-9 whether or not the set variation time has lapsed. Specifically, the main CPU 101*a* determines whether or not the set normal-symbol time counter=0 because a decrement of the normal-symbol time counter takes place every 4 ms. As a result, when it is not determined that the set variation time has lapsed, it is required to continuously produce the variation display. For this reason, the normal-symbol variation processing is terminated and the next subroutine runs.

When determining that the set variation time has lapsed, the main CPU 101*a*, at step S410-10, clears the normal-symbol variation display data so as to stop the variation in normal symbol on the normal-symbol display device 21. At this stage, the main CPU 101*a* operates the normal-symbol display device 21 to stop and display the normal symbol set in the normal-symbol data storage area. In this manner, the player is notified of the result of the lottery for the normal symbol.

At step S410-11, the main CPU 101*a* determines whether or not the normal symbol set in the normal-symbol data storage area is a win symbol. If it is a win symbol, the flow proceeds to step S410-12. If the set normal-symbol is a loss symbol, the normal-symbol variation processing is terminated.

At step S410-12, the main CPU 101*a* sets the normal symbol and prize-winning processing data=1.

At step S410-13, the main CPU 101*a* sets the open time counter of the normal electrically-movable-win-hole device to 875 corresponding to 3500 ms in order to set the open time of the second start-up hole 10 to 3.5 seconds, followed by termination of the normal-symbol variation processing.

(Normal Electrically-Movable-Win-Hole-Device Control Processing)

Figure 22:
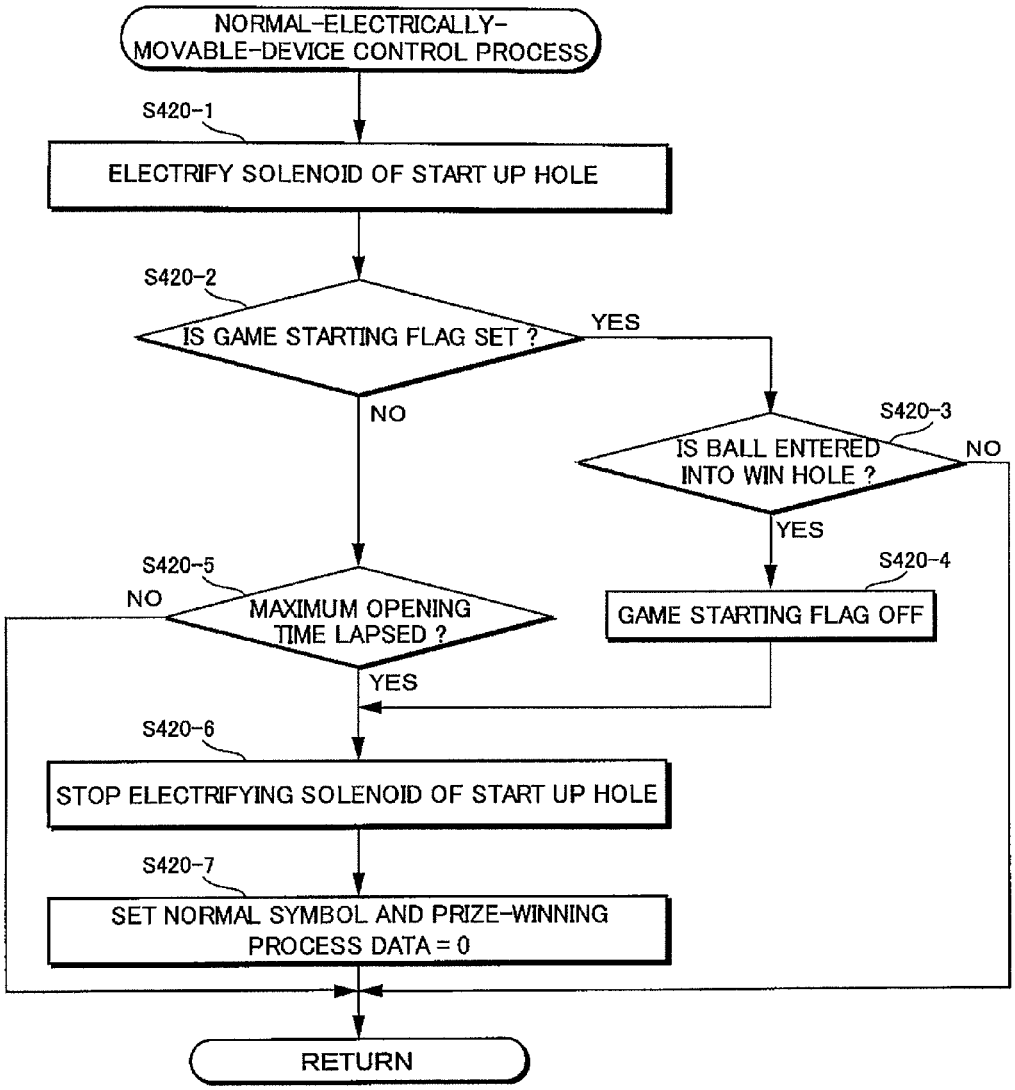
FIG. 22 is a flowchart showing a normal electrically-movable-win-hole-device control processing carried out in the main control circuit board.

Referring next to FIG. 22, the normal electrically-movable-win-hole device control processing will be described.

At step S420-1, the main CPU 101*a* starts the passage of current through the start-up-hole opening and closing solenoid 10*c*. As a result, the second start-up hole 10 is opened and controlled to enter the second mode.

At step S420-2, the main CPU 101*a* refers to the starting-up-flag storage area to determine whether or not the game starting flag is set. If determining that the game starting flag is set, the main CPU 101*a* performs the processing in step S420-3. If the main CPU 101*a* does not determine that the game starting flag is set, the flow proceeds to step S420-5.

At step S420-3, the main CPU 101*a* determines whether or not a playing ball enters any win hole, that is, whether or not the in-one-play-entered-ball counter=0. If the main CPU 101*a* determines that a playing ball enters any win hole, the flow proceeds to step 420-4. If the main CPU 101*a* does not determine that a playing ball enters any win hole, the normal electrically-movable-win-hole device control processing is terminated and the passage of current through the start-up-hole opening and closing solenoid 10*c* is held.

At step S420-4, the main CPU 101*a* clears the game starting flag set in the starting-up-flag storage area. Subsequently, the flow proceeds to step S420-6 to stop the passage of current through the start-up-hole opening and closing solenoid 10*c*.

At step S420-5, the main CPU 101*a* determines whether or not the set open time of normal-electrically-movable-win-hole-device has lapsed, that is, whether or not the normal-electrically-movable-win-hole-device open time counter=0. If the main CPU 101*a* determines that the normal-electrically-movable-win-hole-device open time has lapsed, the flow proceeds to step S420-6. If the main CPU 101*a* does not determine that the normal-electrically-movable-win-hole-device open time has lapsed, the normal electrically-movable-win-hole device control processing is terminated and the passage of current through the start-up-hole opening and closing solenoid 10*c* is held.

At step S420-6, the main CPU 101*a* stops the passage of current through the start-up-hole opening and closing solenoid 10*c*. Thereby, the second start-up hole 10 is placed back in the first mode, which making the entrance of a playing ball difficult or impossible again.

At step S420-7, the main CPU 101*a* sets the normal symbol and prize-winning processing data=0. Subsequently, the flow proceeds to the normal-symbol variation processing shown in FIG. 21, and the normal electrically-movable-win-hole-device control processing is terminated.

In the embodiment, the main CPU 101*a* performing the normal symbol and prize-winning processing forms the electrically-movable-win-hole-device controller.

(Data Creation Processing)

Figure 23:
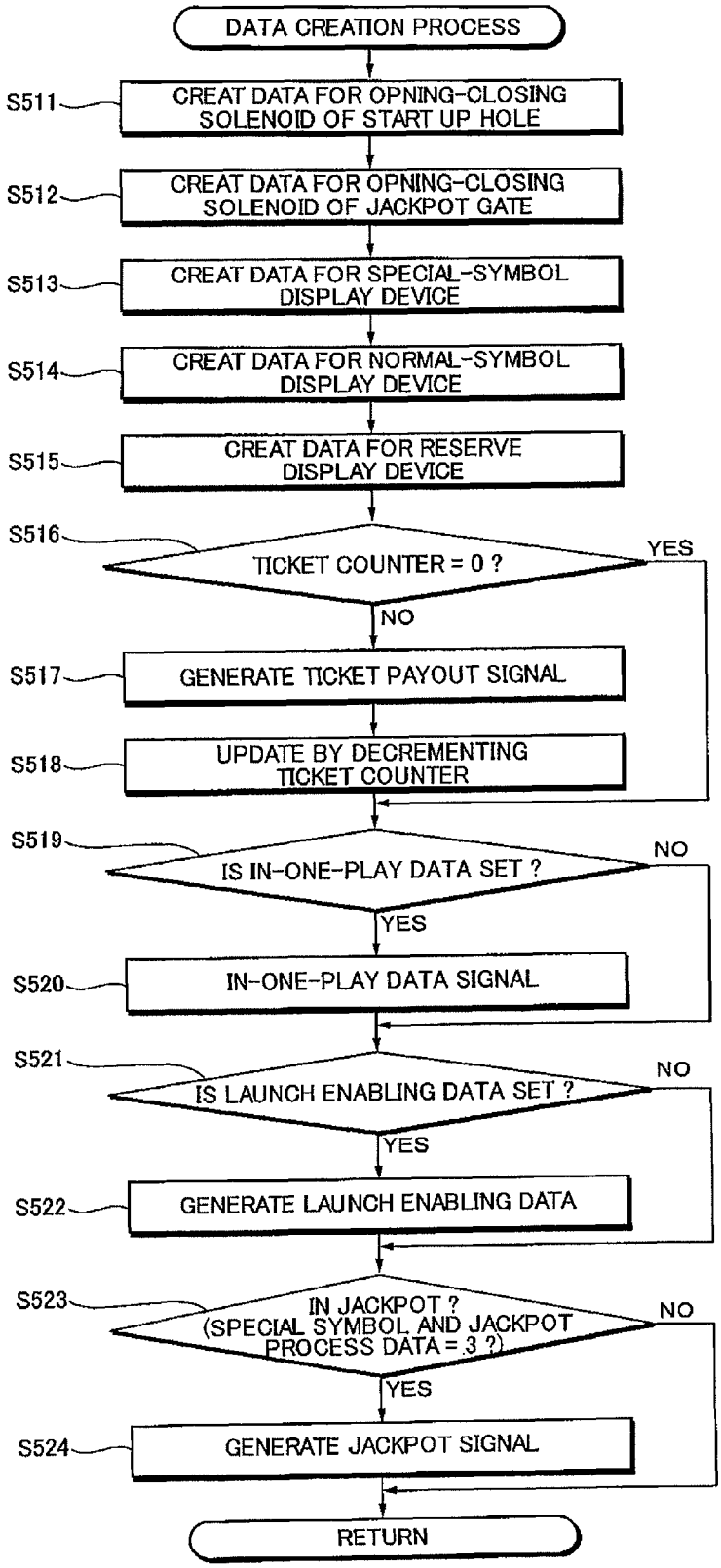
FIG. 23 is a flowchart showing the data creation processing carried out in the main control circuit board.

Referring next to FIG. 23, the data creation processing will be described.

At step S511, the main CPU 101*a* performs data creation processing to generate data required for driving a start-up hole opening and closing solenoid 10*c* in the opened state or closed state.

At step S512, the main CPU 101*a* performs data creation processing to generate data required for driving a jackpot-gate opening and closing solenoid 11*c* in the opened state or closed state.

At step S513, the main CPU 101*a* performs data creation processing to generate data required for switching on or off the light of first special-symbol display device 19 or second special-symbol display device 20.

At step S514, the main CPU 101*a* performs data creation processing to generate data required for switching on or off the light of the normal-symbol display device 21.

At step S515, the main CPU 101*a* refers to data stored in the first special-symbol reserve number (U1) storage area, the second special-symbol reserve number (U2) storage area, and the normal-symbol reserve number (G) storage area. Then, the main CPU 101*a* performs data creation processing to generate data for switching on or off the light of the first special-symbol reserve display 22, the second special-symbol reserve display 23 and the normal-symbol reserve display 24.

At step S516, the main CPU 101*a* determines whether or not the ticket counter=0. If the main CPU 101*a* determines that the ticket counter=0, the flow proceeds to step S519. If the main CPU 101*a* does not determine that the ticket counter=0, the flow proceeds to step S517.

At step S517, the main CPU 101*a* generates a ticket payout signal causing the ticket control circuit board 200 to pay out a ticket.

At step S518, the main CPU 101*a* updates the ticket counter by decrementing by 1, because one ticket payout signal has been generated. This embodiment is constructed such that one pulse of ticket payout signal is generated and outputted every one counter set in the ticket counter. Therefore, if "10" is set in the ticket counter, ten times of the ticket payout signals are generated, so that the respective ticket payout signals are outputted with each one pulse ten times.

At step S519, the main CPU 101*a* refers to one-play storage area and determines whether or not an in-one-play data is set, that is, whether or not one-round-play is in process. If the main 101*a* determines that the in-one-play data is set, the flow proceeds to step S520. If the main CPU 101*a* does not determine that the in-one-play data is set, the flow proceeds to step S521.

At step S520, the main CPU 101*a* generates in-one-play signal which indicates that one-round-play is in process.

At step S521, the main CPU 101*a* refers to the launch enabling data storage area and determines whether or not a launch enabling data is set. If the main CPU 101*a* determines that a launch enabling data is set, the flow proceeds to step S522. If the main CPU 101*a* does not determine that a launch enabling data is set, the flow proceeds to step S523.

At step S522, the main CPU 101*a* generates a launch enabling signal for allowing the launch control circuit board 106 to launch a playing ball.

At step S523, the main CPU 101*a* determines whether or not the ongoing round play is in a jackpot state, that is, whether or not the special-symbol and jackpot processing data is set at 3. If the main CPU 101*a* determines that the ongoing round play is in a jackpot state, the flow proceeds to step S524, and if not, the data creation processing is terminated.

At step S524, the main CPU generates an in-jackpot signal indicating that a jackpot game is controlled. Then, the data creation processing is terminated.

(Output Control Processing)

Figure 24:
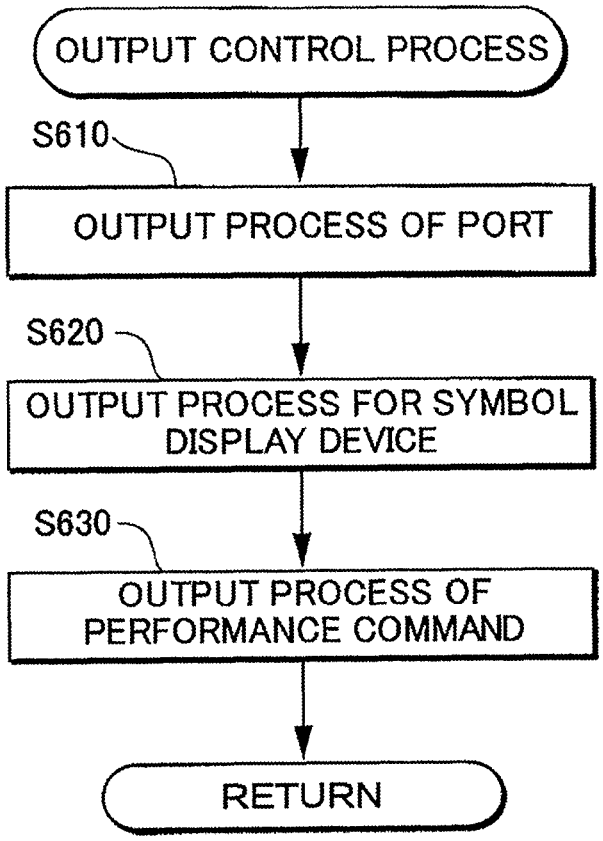
FIG. 24 is a flowchart showing the output control processing carried out in the main control circuit board.

Referring to FIG. 24, the output control processing will be described.

At step S610, the main CPU 101*a* performs output port processing.

In this output port processing, the main CPU 101*a* outputs the start-up hole opening and closing solenoid data generated in step S511 for the start-up hole opening and closing solenoid 10*c*. Likewise, the main CPU 101*a* outputs the jackpot gate opening and closing solenoid data generated in step S512 for the jackpot gate opening and closing solenoid 11*c*.

Further, the main CPU 101*a* outputs the ticket payout signal, the in-one-play signal and the launch enabling signal generated in the data creation processing for the ticket control circuit board 200 through the game information output terminal board 108.

As mentioned above, the embodiment is constructed so that the main control circuit board 101 outputs the ticket payout signal, the in-one-play signal and the launch enabling signal respectively for the ticket control circuit board 200 through the game information output terminal board 108. However, the game machine of the present invention may be constructed so that the main control circuit board 101 outputs the ticket payout signal, the in-one-play signal and the launch enabling signal directly for the ticket control circuit board 200 by directly connecting the main control circuit board 101 with the ticket control circuit board 200.

At step S620, the main CPU 101*a* outputs each data generated in the above-mentioned steps S513 to 515 required for lighting up each LED of the first special-symbol display device 19, the second special-symbol display device 20, the normal-symbol display device 21, the first special-symbol reserve display 22, the second special-symbol reserve display and the normal-symbol reserve display.

At step S630, the main CPU 101*a* performs command output processing for transmitting a command set in the performance-transmission data storage area of the main RAM 101*c* to the performance control circuit board 102.

Next, processing performed by the ticket CPU 200*a* in the ticket control circuit board 200 will be described. In the embodiment, the ticket CPU 200*a* performs at least ticket main processing (see FIG. 25 to FIG. 28) and ticket timer interrupt processing. The former is caused by turning power-on, and the latter is caused by inputting a clock pulse which is generated at predetermined intervals (every 4 ms) by an oscillator circuit arranged in the ticket control circuit board 200.

(Ticket Main Processing of Ticket Control Circuit Board 200)

Figure 25:
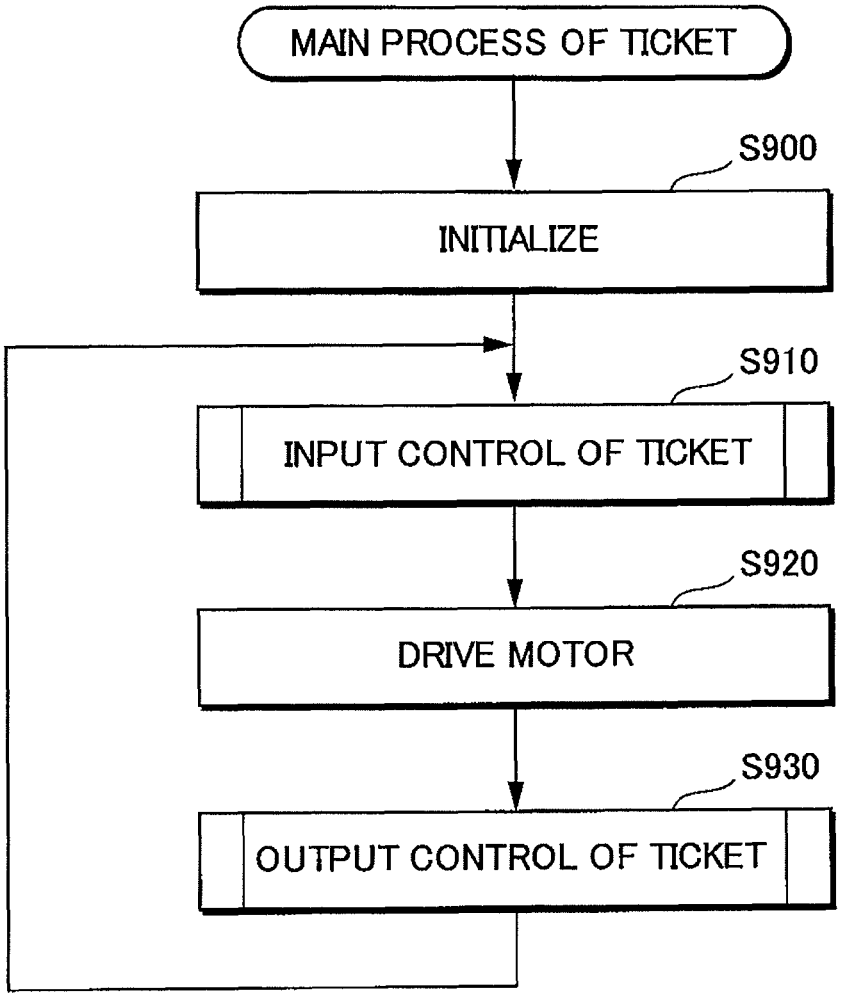
FIG. 25 is a flowchart showing the main processing carried out in a ticket control circuit board.

Referring to FIG. 25, the ticket main processing of the ticket control circuit board 200 will be described.

The power circuit board 107 turns the power on, which then triggers a system reset of the ticket CPU 200*a*. The ticket CPU 200*a* performs the following main processing.

First, at step S900, the ticket CPU 200*a* performs initialization processing. In this initialization processing the ticket CPU 200*a* retrieves a start-up program from the ticket ROM 200*b* upon the power-on, and performs processing for initializing flags and the like stored in the ticket RAM 200*c*.

At step S910, the ticket CPU 200*a* performs ticket input control processing. In the processing, the ticket CPU 200*a* receives a coin insertion signal from the coin detection switch 201*a*, and the ticket payout signal, the in-one-play signal, and the launch enabling signal from the main control circuit board 101. Then, the ticket CPU 200*a* sets respectively predetermined data based on each signal. Details of the ticket input control processing will be described later using FIG. 26 and FIG. 27.

At step S920, the ticket CPU 200*a* outputs driving data for driving the ticket payout motor 202*a* until the payout timer set at step S910-9 described later becomes 0. Besides, as described above, a sheet of the ticket is discharged through the ticket payout slot 202 by every one-second forward rotation of the ticket payout motor 202*a*.

At step S930, the ticket CPU 200*a* performs ticket output control processing. In the processing, the ticket CPU 200*a* outputs game enabling signal for allowing a game of one-round-play to be played to the main control circuit board 101. In addition, the ticket CPU 200*a* outputs data for causing the display section 203*a* of the data display 203 to display the game information of one-round-play. Details of the ticket output control processing will be described later using FIG. 28.

(Ticket Input Control Processing of Ticket Control Circuit Board 200)

Figure 26:
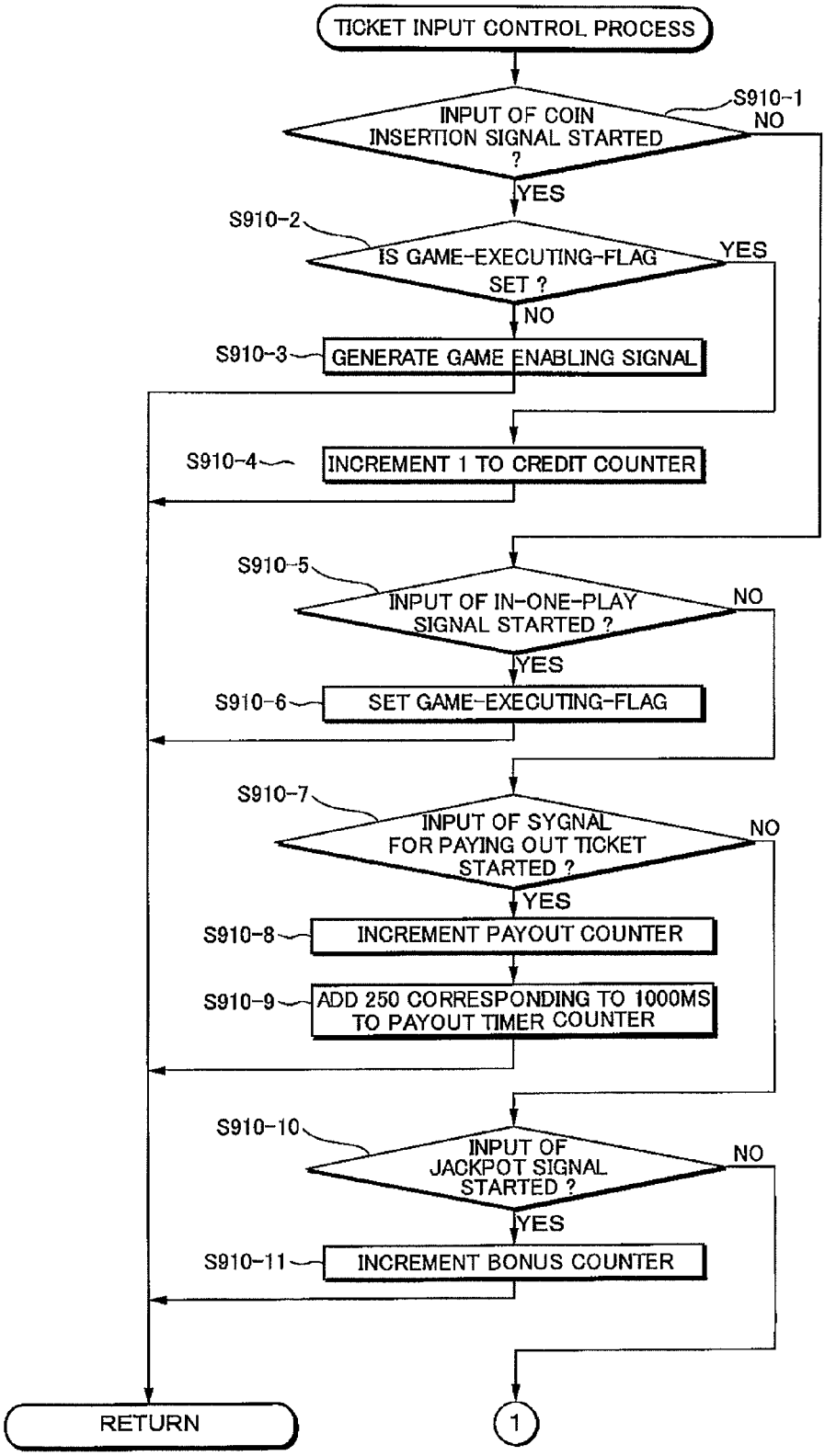
FIG. 26 is a flowchart showing the ticket input control processing 1 carried out in the ticket control circuit board.
Figure 27:
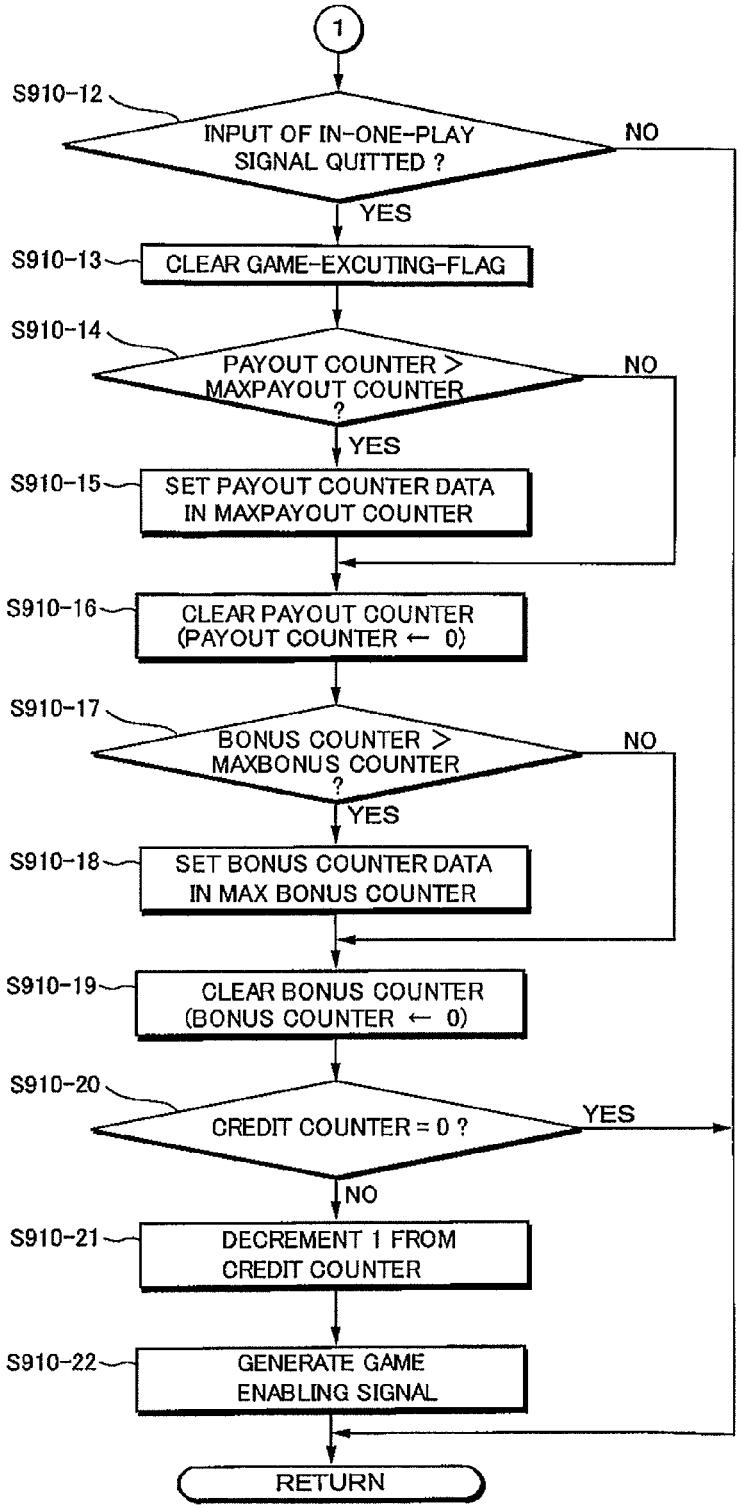
FIG. 27 is a flowchart showing the ticket input control processing 2 carried out in the ticket control circuit board.

Referring to FIGS. 26 and 27, ticket input control processing of the ticket control circuit board 200 is described. Moreover, the ticket input control processing as shown in FIG. 27 is performed subsequently after the ticket input control processing as shown in FIG. 26.

At step S910-1, the ticket CPU 200*a* determines whether or not a rising edge (on-edge) of the coin insertion signal is inputted from the coin detection switch 201*a*. If the ticket CPU 200*a* determines that a rising edge of the coin insertion signal is inputted, the flow proceeds to step S910-2. If the ticket CPU 200*a* does not determine that a rising edge of the coin insertion signal is inputted, the flow proceeds to step S910-5.

At step S910-2, the ticket CPU 200*a* refers to a game-executing-flag storage area, and then determines whether or not a game-executing-flag is set□The game-executing-flag is set during input of in-one-play signal from the main control circuit board 101. That is, the game-executing-flag is information for discriminating that one-round play is being in process by the main control circuit board 101. If the ticket CPU 200*a* determines that the game-executing-flag is set, the flow proceeds to step S910-4. If the ticket CPU 200*a* does not determine that the game-executing-flag is set, the flow proceeds to step S910-3 in order to generate the game enabling signal.

At step S910-3, the ticket CPU 200*a* generates the game enabling signal. The generated game enabling signal is outputted for the main control circuit board 101 at step S931 as described later.

At step 910-4, the ticket CPU 200*a* updates a credit counter by incrementing by 1. The credit counter can buffer such condition that the game enabling signal is not generated although the coin insertion signal has been received.

At step S910-5, the ticket CPU 200*a* determines whether or not a rising edge (on edge) of in-one play signal is inputted from the main control circuit board 101. If the ticket CPU 200*a* determines that a rising edge of the in-one-play signal is inputted, the flow proceeds to step S910-6 in order to set game-executing-flag. If the ticket CPU 200*a* does not determine that a rising edge of the in-one-play signal is inputted, the flow proceeds to step S910-7.

At step S910-6, the ticket CPU 200*a* sets the game-executing flag to the game-executing flag storage area. Herewith, if referring to the game-executing flag, the ticket CPU 200*a* can determine whether one-round-play is in process.

At step S910-7, the ticket CPU 200*a* determines whether or not a rising edge (on edge) of the ticket payout signal is inputted from the main control circuit board 101.

If the ticket CPU 200*a* determines that a rising edge of the ticket payout signal is inputted, the flow proceeds to step S910-8. If the ticket CPU 200*a* does not determine that a rising edge of the ticket payout signal is inputted, the flow proceeds to step S910-10.

At step S910-8, the ticket CPU 200*a* updates PAYOUT counter by incrementing by 1 in order to generate information related to the number of sheet of tickets paid out per one-round play.

At step S910-9, the ticket CPU 200*a* updates the payout time counter by incrementing by 250 corresponding to 1000 ms, because that one sheet of the ticket is discharged through the ticket payout slot 202 every one-second forward rotation of the ticket payout motor 202*a*. Note that the payout time counter is updated by decrementing by 1 every 4 ms in ticket timer interrupt processing (not shown). Therefore, the payout time counter reaches zero after 1000 ms has lapsed.

At step S910-10, the ticket CPU 200*a* determines whether or not a rising edge (on edge) of the jackpot signal is inputted from the main control circuit board 101. If the ticket CPU 200*a* determines that a rising edge of the jackpot signal is inputted, the flow proceeds to step S910-11. If the ticket CPU 200*a* does not determine that a rising edge of the jackpot signal is inputted, the flow proceeds to step S910-12 (See FIG. 27).

At step S910-11, the ticket CPU 200*a* updates the BONUS counter by incrementing by 1 in order to generate information related to jackpot per one-round-play.

At step S910-12, the ticket CPU 200*a* determines whether or not a falling edge (off edge) of in-one-play signal is inputted from the main control circuit board 101. If the ticket CPU 200*a* determines that a falling edge of in-one-play signal is inputted, the flow proceeds to step S910-13 in order to clear the game-executing-flag. If not determining that a falling edge of in-one-play signal is inputted, the ticket input control processing is terminated.

At step S910-13, the ticket CPU 200*a* clears the game-executing-flag set in the game-executing-flag storage area.

At step s910-14, the ticket CPU200*a* determines whether or not the counter value set in PAYOUT counter is greater than the counter value set in MAXPAYOUT counter. If the ticket CPU200*a* determines that the counter set in PAYOUT counter is greater, the flow proceeds to step S910-15. If not determining that the counter value set in PAYOUT counter is greater, the flow proceeds to step S910-16. The MAXPAYOUT counter stores the greatest value of the number of PAYOUT counter. The MAXPAYOUT counter is set 0 at the time of power-on.

At step S910-15, the ticket CPU 200*a* sets counter-data set in the PAYOUT counter also in the MAXPAYOUT counter. As a result, the MAXPAYOUT counter is updated.

At step S910-16, the ticket CPU 200*a* clears the PAYOUT counter because one-round-play is terminated at this stage, that is the ticket CPU 200*a* sets 0 in the PAYOUT counter.

At step S910-17, the ticket CPU 200*a* determines whether or not the counter value set in BONUS counter is greater than the counter value set in MAXBONUS counter. If the ticket CPU 200*a* determines that the counter value set in BONUS counter is greater, the flow proceeds to step S910-18. If not determining that the counter value set in BONUS counter is greater, the flow proceeds to step S910-19. The MAXBONUS counter stores the greatest value of the BONUS counter. The MAXBONUS counter is set 0 at the time of power-on.

In the embodiment, the ticket CPU 200*a* comparing the MAYPAYOUT counter with the PAYOUT counter at step S910-14 or the MAXBONUS counter with the BONUS counter at step S910-17 forms the comparison determination device.

At step S910-18, the ticket CPU 200*a* sets counter-data set in the BONUS counter also in the MAXBONUS counter. As a result, the MAXBONUS counter is updated.

In the embodiment, the ticket CPU 200*a* updating the MAYPAYOUT counter at step S910-15 or the MAXBONUS counter at step S910-18 forms the update storing device.

At step S910-19, because one-round-play is terminated at this stage, the ticket CPU 200*a* clears the BONUS counter, that is, the ticket CPU 200*a* sets 0 in the BONUS counter.

At step S910-20, because one-round-play is terminated at this stage, the ticket CPU 200*a* determines whether or not the credit counter=0. If the ticket CPU 200*a* does not determine that the credit counter=0, the flow proceeds to step S910-21. If the ticket CPU 200*a* determines that the credit counter=0, the ticket input control processing is terminated.

At step S910-21, the ticket CPU 200*a* updates the credit counter by decrementing by 1 from the credit counter.

At step S910-22, the ticket CPU 200*a* generates game enabling signal. Then, the ticket input control processing is terminated. In this way, when information except 0 is stored in the credit counter at the time that one-round-play is terminated, the ticket CPU 200*a* can generate and output automatically game enabling signal.

In the embodiment, the ticket CPU 200*a* performing the ticket input control processing for updating at least one of the PAYOUT counter, the MAXPAYOUT counter, the BONUS counter and the MAXBONUS counter forms the privilege-frequency counter. Besides, in the embodiment, the ticket CPU 200*a* generating game-enabling-signal in the ticket input control processing forms the game-enabling-signal generation device.

(Ticket Output Control Processing of Ticket Control Circuit Board 200)

Figure 28:
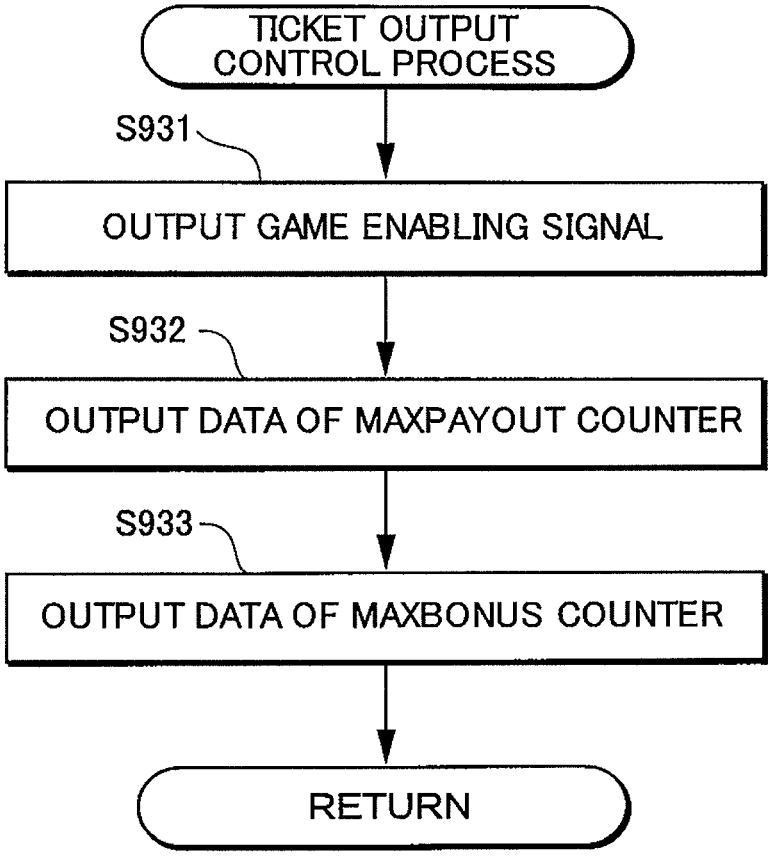
FIG. 28 is a flowchart showing the ticket output control processing carried out in the ticket control circuit board.

Referring to FIG. 28, the ticket output control processing of the ticket control circuit board 200 will be described.

At step S931, the ticket CPU 200*a* outputs one-pulse of the game-enabling-signal generated at step S910-3 and S910-22 for the main control circuit board 101. When receiving one-pulse of the game-enabling-signal, the main control circuit board 101 executes one-round-play.

In the embodiment, the ticket CPU 200*a* outputting game-enabling-signal forms the game enabling signal output device.

At step S932, the ticket CPU 200*a* refers to the MAXPAYOUT counter, and then generates data of MAXPAYOUT based on the number of times (counter value) stored in the MAYPAYOUT counter. Then, the ticket CPU 200*a* outputs the generated data of MAXPAYOUT for the data display 203.

At step S933, the ticket CPU 200*a* refers to the MAXBONUS counter, and then generates data of MAXBONUS based on the number of times (counter value) stored in the MAXBONUS counter. Then, the ticket CPU 200*a* outputs the generated data of MAXBONUS for the data display 203. When this processing is terminated, the ticket output control processing is terminated.

In the embodiment, the ticket CPU 200*a* performing the game information controller configured to generate at least one of data of the MAXPAYOUT counter and the MAXBONUS counter, and outputting the generated data for the data display 203 forms the privilege-frequency counter.

Next, the outline of the performance control circuit board 102 will be described.

The performance control circuit board 102 receives the command sent from the main control circuit board 101, which then triggers the command receive interrupt processing of the performance control circuit board 102. Then, the performance control circuit board 102 buffers the received command.

The performance control circuit board 102 performs the timer interrupt processing every 2 ms, in which then the sub CPU 102*a* generates each kind of data corresponding to each command after the sub CPU 102*a* in the performance control circuit board 102 analyses the received command. Next, each generated data is sent to the image control circuit board 105 or the lamp control circuit board 104.

Specifically, when receiving the variation-pattern specifying command from the main control circuit board 101, the sub CPU 102*a* refers to the performance-pattern determination table stored in the sub ROM 102*b*. Based on the received variation-pattern specifying command, the sub CPU 102*a* determines the performance pattern for causing the performance display device 13, the audio output unit 18, the performance illumination device 16 and the performance figure device 15 to execute a predetermined performance. Then, the sub CPU 102*a* generates the performance data corresponding to the determined performance pattern, and sends the related performance data to the image control circuit board 105 and the lamp control circuit board 104.

In addition, when the sub CPU 102*a* receives a performance-symbol specifying command which indicates "jackpot", the sub CPU 102*a* refers to the in-jackpot-performance-symbol determination table. Then, the sub CPU 102*a* determines the performance-symbol data based on the received performance-symbol specifying command. Then, the sub CPU 102*a* sends the determined performance-symbol data to the image control circuit board 105 or the lamp control circuit board 104. In this manner, any combination of a specific pattern of the performance-symbol is stopped and displayed on the performance display device 13 statically.

Furthermore, in the case of the performance-symbol indicating "loss" also, the sub CPU 102*a* stores an in-loss performance-symbol determination table (not shown). The in-loss performance-symbol determination table is formed with combinations except the pattern of special performance symbol 30.

Next, the outline of the image control circuit board 105 and the lamp control circuit board 104 will be described.

When the image control circuit board 105 receives data from the performance control circuit board 102, the audio CPU reads out the audio-output-unit control program from the audio ROM and controls audio-output in the audio output unit 18. In the same way, the image CPU reads out the program from the image ROM and control image-display in the performance display device 13 based on the received the performance command.

Similarly, when the lamp control circuit board 104 receives data from the performance control circuit board 102, the lamp control circuit board 104 reads out the performance-decorative device program based on the received data. Then, the lamp control circuit board 104 controls operation of the performance figure device 15. In the same way, the lamp control circuit board 104 read out the performance illumination device control program based on the received performance data. Then, based on the program to be read out, the lamp control circuit board 104 controls the performance illumination device 16.

The game machine of the present embodiments is constructed such that one game machine is equipped with one pachinko unit. However, one game machine may be equipped with a plurality of pachinko units.

Besides, in the case of performing variation-display in the embodiment, after the predetermined variation time of varying the special symbol has lapsed, the special-symbol stop display is performed. However, "a stop switch" can be formed in the main control unit 101. In this case, the special-symbol stop display may be performed by operating the stop switch.

In the embodiment, the probability of jackpot in the low probability game state (1/64) is fixed. However, the probability of jackpot may be variable by arranging and operating "condition changing switch" in the main control circuit board 101.

Further, in the embodiment one time of game enabling signal is outputted one time with inputting one time of the coin insertion signal (so-called "one-coin-one-play"). However, this invention's machine may be constructed so that the one time of game-enabling signal is outputted with inputting a plurality of coin insertion signal, by arranging "coin number changing switch" in the ticket control circuit board 200.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A game machine, comprising:

a game board provided with a playfield on which playing balls cascade downward;

a launching-operation detector configured to detect a launching operation by a player to start launching the playing balls;

an inserted-medium detector configured to detect that a predetermined inserted-medium is received into the game machine;

a playing-time counter configured to start to count a predetermined time of play when said inserted-medium detector detects that a predetermined inserted-medium is received;

a one-game-play execution device configured to perform one game play, at least until the predetermined time of play as counted by said playing-time counter has lapsed, when said inserted-medium detector detects that the predetermined inserted-medium is received;

a launching device configured to launch the playing balls toward the playfield when the launching operation by the player is detected by said launching-operation detector under the condition that the one game play is currently performed by said one-game-play execution device;

a special electrically-movable-win-hole device being variable between an opened state in which the playing ball readily enters a special win hole provided on the playfield and a closed state for making it difficult for the playing ball to enter the special win hole;

a start-up-hole detector configured to detect that the playing ball enters a start-up hole provided on the playfield;

a special game determination device configured to determine whether or not to control a special game in which said special electrically-movable-win-hole device is driven into the opened state, when the start-up hole detector detects that the playing ball enters the start-up hole;

a special game controller configured to control the special game under the condition that the special game determination device determines to control the special game;

a game-information displaying device configured to display information related to game;

a prize counter configured to count a number of prizes at which the special game controller controls the special game during performance of one game play by said one-game-play execution device; and a game-information controller configured to control said game-information displaying device to display game information indicating a number of prizes counted by said prize counter, wherein said one-round-play execution device continues the one game play, after the predetermined time of play as counted by said playing-time counter has lapsed, when the special game controller controls the special game.

2. The game machine according to claim 1, further comprising:

a prizes-in-one-play storing device configured to store the number of prizes counted by said prize counter during performance of one game play by said one-game-play execution device;

a maximum-prize-number storing device configured to store the maximum number of prizes already counted by said prize counter;

a comparison determination device configured to compare and determine whether the number of prizes stored in said prizes-in-one-play storing device is greater than that of a number of prizes stored in said maximum-prize-number storing device; and an update storing device configured to update and store the number of prizes stored in said prizes-in-one-play storing device to the maximum number of prizes to be stored in said maximum-prize-number storing device, if said comparison determination device determines that the number of prizes stored in said prizes-in-one-play storing device is greater than the stored maximum number of prizes, wherein said game-information controller controls said game-information displaying device to display game information indicating the number of prizes stored in said maximum-prize-number storing device.

* * * * *